US009660360B2

(12) United States Patent
Ehret et al.

(10) Patent No.: US 9,660,360 B2
(45) **Date of Patent: *May 23, 2017**

(54) CONNECTOR PRODUCING A BIASING FORCE

(71) Applicant: PPC Broadband, Inc, East Syracuse, NY (US)

(72) Inventors: Trevor Ehret, North Haven, CT (US); Richard A. Haube, Cazenovia, NY (US); Noah P. Montena, Syracuse, NY (US); Souheil Zraik, Liverpool, NY (US)

(73) Assignee: PPC Broadband, Inc., East Syracuse, NY (US)

( * ) Notice: Subject to any disclaimer, the term of this patent is extended or adjusted under 35 U.S.C. 154(b) by 135 days.

This patent is subject to a terminal disclaimer.

(21) Appl. No.: 14/173,462

(22) Filed: Feb. 5, 2014

(65) Prior Publication Data

US 2014/0315429 A1 Oct. 23, 2014

Related U.S. Application Data

(63) Continuation of application No. 13/913,043, filed on Jun. 7, 2013, which is a continuation of application (Continued)

(51) Int. Cl.
*H01R 9/05* (2006.01)
*H01R 43/00* (2006.01)

(Continued)

(52) U.S. Cl.
CPC ..... *H01R 9/0521* (2013.01); *H01R 4/48* (2013.01); *H01R 9/05* (2013.01); *H01R 9/0527* (2013.01); *H01R 13/5025* (2013.01); *H01R 13/62* (2013.01); *H01R 43/00* (2013.01); *H01R 43/16* (2013.01); *H01R 43/26* (2013.01); *H01R 13/5202* (2013.01); *H01R 13/622* (2013.01); *H01R 43/20* (2013.01);

(Continued)

(58) Field of Classification Search
CPC ..... H01R 9/0521; H01R 9/05; H01R 43/16; H01R 43/00; H01R 4/16; H01R 4/48; H01R 13/52025; H01R 9/0527; H01R 43/26
USPC ..... 439/578–583
See application file for complete search history.

(56) References Cited

U.S. PATENT DOCUMENTS 331,169 A 11/1885 Thomas
1,371,742 A 3/1921 Dringman (Continued)

FOREIGN PATENT DOCUMENTS

CA 2096710.00 A1 11/1994
CN 101060690.00 A 10/2007

(Continued)

OTHER PUBLICATIONS

EESR1; Extended European Search Report; European Application No. 12763440.0; Date of Mailing: Jul. 22, 2014; 9 pages.

(Continued)

*Primary Examiner* — Briggitte R Hammond
(74) *Attorney, Agent, or Firm* — Barclay Damon, LLP

(57) ABSTRACT

A connector includes, in one embodiment, a first component, a coupling element configured to engage the first component, and a second component configured to engage the first component. The second component, in one embodiment, is configured to produce a spring, pushing or biasing force.

37 Claims, 11 Drawing Sheets

Related U.S. Application Data

No. 13/726,330, filed on Dec. 24, 2012, now Pat. No. 8,480,430, which is a continuation of application No. 13/075,406, filed on Mar. 30, 2011, now Pat. No. 8,366,481.

(51) Int. Cl.

| | |
|---|---|
| ***H01R 43/16*** | (2006.01) |
| ***H01R 43/26*** | (2006.01) |
| ***H01R 4/48*** | (2006.01) |
| ***H01R 13/62*** | (2006.01) |
| ***H01R 13/502*** | (2006.01) |
| *H01R 43/20* | (2006.01) |
| *H01R 13/52* | (2006.01) |
| *H01R 13/622* | (2006.01) |

(52) U.S. Cl.

CPC .... *Y10T 29/49174* (2015.01); *Y10T 29/49204* (2015.01); *Y10T 29/49208* (2015.01)

(56) References Cited

U.S. PATENT DOCUMENTS 1,667,485 A 4/1928 MacDonald
1,766,869 A 6/1930 Austin
1,801,999 A 4/1931 Bowman
1,885,761 A 11/1932 Peirce, Jr.
2,013,526 A 9/1935 Schmitt
2,102,495 A 12/1937 England
2,258,737 A 10/1941 Browne
2,325,549 A 7/1943 Ryzowitz
2,480,963 A 9/1949 Quinn
2,544,654 A 3/1951 Brown
2,549,647 A 4/1951 Turenne
2,665,729 A 1/1954 Terry
2,694,187 A 11/1954 Nash
2,694,817 A 11/1954 Roderick
2,754,487 A 7/1956 Carr et al.
2,755,331 A 7/1956 Melcher
2,757,351 A 7/1956 Klostermann
2,762,025 A 9/1956 Melcher
2,805,399 A 9/1957 Leeper
2,816,949 A 12/1957 Curtiss
2,870,420 A 1/1959 Malek
3,001,169 A 9/1961 Blonder
3,015,794 A 1/1962 Kishbaugh
3,091,748 A 5/1963 Takes et al.
3,094,364 A 6/1963 Lingg
3,184,706 A 5/1965 Atkins
3,194,292 A 7/1965 Borowsky
3,196,382 A 7/1965 Morello, Jr.
3,245,027 A 4/1966 Ziegler, Jr.
3,275,913 A 9/1966 Blanchard et al.
3,278,890 A 10/1966 Cooney
3,281,757 A 10/1966 Bonhomme
3,292,136 A 12/1966 Somerset
3,320,575 A 5/1967 Brown et al.
3,321,732 A 5/1967 Forney, Jr.
3,336,563 A 8/1967 Hyslop
3,348,186 A 10/1967 Rosen
3,350,677 A 10/1967 Daum
3,355,698 A 11/1967 Keller
3,373,243 A 3/1968 Janowiak et al.
3,390,374 A 6/1968 Forney, Jr.
3,406,373 A 10/1968 Forney, Jr.
3,430,184 A 2/1969 Acord
3,448,430 A 6/1969 Kelly
3,453,376 A 7/1969 Ziegler, Jr. et al.
3,465,281 A 9/1969 Florer
3,475,545 A 10/1969 Stark et al.
3,494,400 A 2/1970 McCoy et al.
3,498,647 A 3/1970 Schroder
3,501,737 A 3/1970 Harris et al.
3,517,373 A 6/1970 Jamon
3,526,871 A 9/1970 Hobart
3,533,051 A 10/1970 Ziegler, Jr.
3,537,065 A 10/1970 Winston
3,544,705 A 12/1970 Winston
3,551,882 A 12/1970 O'Keefe
3,564,487 A 2/1971 Upstone et al.
3,587,033 A 6/1971 Brorein et al.
3,601,776 A 8/1971 Curl
3,629,792 A 12/1971 Dorrell
3,633,150 A 1/1972 Swartz
3,646,502 A 2/1972 Hutter et al.
3,663,926 A 5/1972 Brandt
3,665,371 A 5/1972 Cripps
3,668,612 A 6/1972 Nepovim
3,669,472 A 6/1972 Nadsady
3,671,922 A 6/1972 Zerlin et al.
3,678,444 A 7/1972 Stevens et al.
3,678,445 A 7/1972 Brancaleone
3,680,034 A 7/1972 Chow et al.
3,681,739 A 8/1972 Kornick
3,683,320 A 8/1972 Woods et al.
3,686,623 A 8/1972 Nijman
3,694,792 A 9/1972 Wallo
3,706,958 A 12/1972 Blanchenot
3,710,005 A 1/1973 French
3,739,076 A 6/1973 Schwartz
3,744,007 A 7/1973 Horak
3,744,011 A 7/1973 Blanchenot
3,778,535 A 12/1973 Forney, Jr.
3,781,762 A 12/1973 Quackenbush
3,781,898 A 12/1973 Holloway
3,793,610 A 2/1974 Brishka
3,798,589 A 3/1974 Deardurff
3,808,580 A 4/1974 Johnson
3,810,076 A 5/1974 Hutter
3,835,443 A 9/1974 Arnold et al.
3,836,700 A 9/1974 Niemeyer
3,845,453 A 10/1974 Hemmer
3,846,738 A 11/1974 Nepovim
3,854,003 A 12/1974 Duret
3,858,156 A 12/1974 Zarro
3,870,978 A 3/1975 Dreyer
3,879,102 A 4/1975 Horak
3,886,301 A 5/1975 Cronin et al.
3,907,399 A 9/1975 Spinner
3,910,673 A 10/1975 Stokes
3,915,539 A 10/1975 Collins
3,936,132 A 2/1976 Hutter
3,953,097 A 4/1976 Graham
3,960,428 A 6/1976 Naus et al.
3,963,320 A 6/1976 Spinner
3,963,321 A 6/1976 Burger et al.
3,970,355 A 7/1976 Pitschi
3,972,013 A 7/1976 Shapiro
3,976,352 A 8/1976 Spinner
3,980,805 A 9/1976 Lipari
3,985,418 A 10/1976 Spinner
4,017,139 A 4/1977 Nelson
4,022,966 A 5/1977 Gajajiva
4,030,798 A 6/1977 Paoli
4,046,451 A 9/1977 Juds et al.
4,053,200 A 10/1977 Pugner
4,059,330 A 11/1977 Shirey
4,079,343 A 3/1978 Nijman
4,082,404 A 4/1978 Flatt
4,090,028 A 5/1978 Vontobel
4,093,335 A 6/1978 Schwartz et al.
4,106,839 A 8/1978 Cooper
4,109,126 A 8/1978 Halbeck
4,125,308 A 11/1978 Schilling
4,126,372 A 11/1978 Hashimoto et al.
4,131,332 A 12/1978 Hogendobler et al.
4,150,250 A 4/1979 Lundeberg
4,153,320 A 5/1979 Townshend
4,156,554 A 5/1979 Aujla
4,165,911 A 8/1979 Laudig
4,168,921 A 9/1979 Blanchard
4,173,385 A 11/1979 Fenn et al.
4,174,875 A 11/1979 Wilson et al.

(56) References Cited

U.S. PATENT DOCUMENTS 4,187,481 A 2/1980 Boutros
4,193,655 A 3/1980 Herrmann, Jr.
4,194,338 A 3/1980 Trafton
4,213,664 A 7/1980 McClenan
4,225,162 A 9/1980 Dola
4,227,765 A 10/1980 Neumann et al.
4,229,714 A 10/1980 Yu
4,250,348 A 2/1981 Kitagawa
4,280,749 A 7/1981 Hemmer
4,285,564 A 8/1981 Spinner
4,290,663 A 9/1981 Fowler et al.
4,296,986 A 10/1981 Herrmann et al.
4,307,926 A 12/1981 Smith
4,322,121 A 3/1982 Riches et al.
4,326,769 A 4/1982 Dorsey et al.
4,339,166 A 7/1982 Dayton
4,346,958 A 8/1982 Blanchard
4,354,721 A 10/1982 Luzzi
4,358,174 A 11/1982 Dreyer
4,359,254 A 11/1982 Gallusser
4,373,767 A 2/1983 Cairns
4,389,081 A 6/1983 Gallusser et al.
4,400,050 A 8/1983 Hayward
4,407,529 A 10/1983 Holman
4,408,821 A 10/1983 Forney, Jr.
4,408,822 A 10/1983 Nikitas
4,412,717 A 11/1983 Monroe
4,421,377 A 12/1983 Spinner
4,426,127 A 1/1984 Kubota
4,444,453 A 4/1984 Kirby et al.
4,452,503 A 6/1984 Forney, Jr.
4,456,323 A 6/1984 Pitcher et al.
4,462,653 A 7/1984 Flederbach et al.
4,464,000 A 8/1984 Werth et al.
4,464,001 A 8/1984 Collins
4,469,386 A 9/1984 Ackerman
4,470,657 A 9/1984 Deacon
4,484,792 A 11/1984 Tengler et al.
4,484,796 A 11/1984 Sato et al.
4,490,576 A 12/1984 Bolante et al.
4,506,943 A 3/1985 Drogo
4,515,427 A 5/1985 Smit
4,525,017 A 6/1985 Schildkraut et al.
4,531,790 A 7/1985 Selvin
4,531,805 A 7/1985 Werth
4,533,191 A 8/1985 Blackwood
4,540,231 A 9/1985 Forney, Jr.
RE31,995 E 10/1985 Ball
4,545,637 A 10/1985 Bosshard et al.
4,575,274 A 3/1986 Hayward
4,580,862 A 4/1986 Johnson
4,580,865 A 4/1986 Fryberger
4,583,811 A 4/1986 McMills
4,585,289 A 4/1986 Bocher
4,588,246 A 5/1986 Schildkraut et al.
4,593,964 A 6/1986 Forney, Jr. et al.
4,596,434 A 6/1986 Saba et al.
4,596,435 A 6/1986 Bickford
4,597,621 A 7/1986 Burns
4,598,959 A 7/1986 Selvin
4,598,961 A 7/1986 Cohen
4,600,263 A 7/1986 DeChamp et al.
4,613,199 A 9/1986 McGeary
4,614,390 A 9/1986 Baker
4,616,900 A 10/1986 Cairns
4,632,487 A 12/1986 Wargula
4,634,213 A 1/1987 Larsson et al.
4,640,572 A 2/1987 Conlon
4,645,281 A 2/1987 Burger
4,650,228 A 3/1987 McMills et al.
4,655,159 A 4/1987 McMills
4,655,534 A 4/1987 Stursa
4,660,921 A 4/1987 Hauver
4,668,043 A 5/1987 Saba et al.
4,673,236 A 6/1987 Musolff et al.
4,674,818 A 6/1987 McMills et al.
4,676,577 A 6/1987 Szegda
4,682,832 A 7/1987 Punako et al.
4,684,201 A 8/1987 Hutter
4,688,876 A 8/1987 Morelli
4,688,878 A 8/1987 Cohen et al.
4,690,482 A 9/1987 Chamberland et al.
4,691,976 A 9/1987 Cowen
4,703,987 A 11/1987 Gallusser et al.
4,703,988 A 11/1987 Raux et al.
4,717,355 A 1/1988 Mattis
4,720,155 A 1/1988 Schildkraut et al.
4,734,050 A 3/1988 Negre et al.
4,734,666 A 3/1988 Ohya et al.
4,737,123 A 4/1988 Paler et al.
4,738,009 A 4/1988 Down et al.
4,738,628 A 4/1988 Rees
4,739,126 A 4/1988 Gutter et al.
4,746,305 A 5/1988 Nomura
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,789,759 A 12/1988 Jones
4,795,360 A 1/1989 Newman et al.
4,797,120 A 1/1989 Ulery
4,806,116 A 2/1989 Ackerman
4,807,891 A 2/1989 Neher
4,808,128 A 2/1989 Werth
4,813,886 A 3/1989 Roos et al.
4,820,185 A 4/1989 Moulin
4,834,675 A 5/1989 Samchisen
4,835,342 A 5/1989 Guginsky
4,836,801 A 6/1989 Ramirez
4,838,813 A 6/1989 Pauza et al.
4,854,893 A 8/1989 Morris
4,857,014 A 8/1989 Alf et al.
4,867,706 A 9/1989 Tang
4,869,679 A 9/1989 Szegda
4,874,331 A 10/1989 Iverson
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,934,960 A 6/1990 Capp et al.
4,938,718 A 7/1990 Guendel
4,941,846 A 7/1990 Guimond et al.
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,059,747 A 10/1991 Bawa et al.
5,062,804 A 11/1991 Jamet et al.
5,066,248 A 11/1991 Gaver, Jr. et al.
5,073,129 A 12/1991 Szegda

(56) References Cited

U.S. PATENT DOCUMENTS

| | | | |
|---|---|---|---|
| 5,080,600 | A | 1/1992 | Baker et al. |
| 5,083,943 | A | 1/1992 | Tarrant |
| 5,120,260 | A | 6/1992 | Jackson |
| 5,127,853 | A | 7/1992 | McMills et al. |
| 5,131,862 | A | 7/1992 | Gershfeld |
| 5,137,470 | A | 8/1992 | Doles |
| 5,137,471 | A | 8/1992 | Verespej et al. |
| 5,141,448 | A | 8/1992 | Mattingly et al. |
| 5,141,451 | A | 8/1992 | Down |
| 5,149,274 | A | 9/1992 | Gallusser et al. |
| 5,154,636 | A | 10/1992 | Vaccaro et al. |
| 5,161,993 | A | 11/1992 | Leibfried, Jr. |
| 5,166,477 | A | 11/1992 | Perin, Jr. et al. |
| 5,169,323 | A | 12/1992 | Kawai et al. |
| 5,181,161 | A | 1/1993 | Hirose et al. |
| 5,183,417 | A | 2/1993 | Bools |
| 5,186,501 | A | 2/1993 | Mano |
| 5,186,655 | A | 2/1993 | Glenday et al. |
| 5,195,905 | A | 3/1993 | Pesci |
| 5,195,906 | A | 3/1993 | Szegda |
| 5,205,547 | A | 4/1993 | Mattingly |
| 5,205,761 | A | 4/1993 | Nilsson |
| 5,207,602 | A | 5/1993 | McMills et al. |
| 5,215,477 | A | 6/1993 | Weber et al. |
| 5,217,391 | A | 6/1993 | Fisher, Jr. |
| 5,217,393 | A | 6/1993 | Del Negro et al. |
| 5,221,216 | A | 6/1993 | Gabany et al. |
| 5,227,587 | A | 7/1993 | Paterek |
| 5,247,424 | A | 9/1993 | Harris et al. |
| 5,269,701 | A | 12/1993 | Leibfried, Jr. |
| 5,283,853 | A | 2/1994 | Szegda |
| 5,284,449 | A | 2/1994 | Vaccaro |
| 5,294,864 | A | 3/1994 | Do |
| 5,295,864 | A | 3/1994 | Birch et al. |
| 5,316,494 | A | 5/1994 | Flanagan et al. |
| 5,318,459 | A | 6/1994 | Shields |
| 5,321,205 | A | 6/1994 | Bawa et al. |
| 5,334,032 | A | 8/1994 | Myers et al. |
| 5,334,051 | A | 8/1994 | Devine et al. |
| 5,338,225 | A | 8/1994 | Jacobsen et al. |
| 5,342,218 | A | 8/1994 | McMills et al. |
| 5,354,217 | A | 10/1994 | Gabel et al. |
| 5,362,250 | A | 11/1994 | McMills et al. |
| 5,371,819 | A | 12/1994 | Szegda |
| 5,371,821 | A | 12/1994 | Szegda |
| 5,371,827 | A | 12/1994 | Szegda |
| 5,380,211 | A | 1/1995 | Kawaguchi et al. |
| 5,389,005 | A | 2/1995 | Kodama |
| 5,393,244 | A | 2/1995 | Szegda |
| 5,397,252 | A | 3/1995 | Wang |
| 5,413,504 | A | 5/1995 | Kloecker et al. |
| 5,431,583 | A | 7/1995 | Szegda |
| 5,435,745 | A | 7/1995 | Booth |
| 5,435,751 | A | 7/1995 | Papenheim et al. |
| 5,439,386 | A | 8/1995 | Ellis et al. |
| 5,444,810 | A | 8/1995 | Szegda |
| 5,455,548 | A | 10/1995 | Grandchamp et al. |
| 5,456,611 | A | 10/1995 | Henry et al. |
| 5,456,614 | A | 10/1995 | Szegda |
| 5,466,173 | A | 11/1995 | Down |
| 5,470,257 | A | 11/1995 | Szegda |
| 5,474,478 | A | 12/1995 | Ballog |
| 5,490,033 | A | 2/1996 | Cronin |
| 5,490,801 | A | 2/1996 | Fisher, Jr. et al. |
| 5,494,454 | A | 2/1996 | Johnsen |
| 5,499,934 | A | 3/1996 | Jacobsen et al. |
| 5,501,616 | A | 3/1996 | Holliday |
| 5,509,823 | A | 4/1996 | Harting et al. |
| 5,516,303 | A | 5/1996 | Yohn et al. |
| 5,525,076 | A | 6/1996 | Down |
| 5,542,861 | A | 8/1996 | Anhalt et al. |
| 5,548,088 | A | 8/1996 | Gray et al. |
| 5,550,521 | A | 8/1996 | Bernaud et al. |
| 5,564,938 | A | 10/1996 | Shenkal et al. |
| 5,571,028 | A | 11/1996 | Szegda |
| 5,586,910 | A | 12/1996 | Del Negro et al. |
| 5,595,499 | A | 1/1997 | Zander et al. |
| 5,598,132 | A | 1/1997 | Stabile |
| 5,607,325 | A | 3/1997 | Toma |
| 5,620,339 | A | 4/1997 | Gray et al. |
| 5,632,637 | A | 5/1997 | Diener |
| 5,632,651 | A | 5/1997 | Szegda |
| 5,644,104 | A | 7/1997 | Porter et al. |
| 5,651,698 | A | 7/1997 | Locati et al. |
| 5,651,699 | A | 7/1997 | Holliday |
| 5,653,605 | A | 8/1997 | Woehl et al. |
| 5,667,405 | A | 9/1997 | Holliday |
| 5,681,172 | A | 10/1997 | Moldenhauer |
| 5,683,263 | A | 11/1997 | Hse |
| 5,702,263 | A | 12/1997 | Baumann et al. |
| 5,722,856 | A | 3/1998 | Fuchs et al. |
| 5,735,704 | A | 4/1998 | Anthony |
| 5,746,617 | A | 5/1998 | Porter, Jr. et al. |
| 5,746,619 | A | 5/1998 | Harting et al. |
| 5,769,652 | A | 6/1998 | Wider |
| 5,775,927 | A | 7/1998 | Wider |
| 5,863,220 | A | 1/1999 | Holliday |
| 5,877,452 | A | 3/1999 | McConnell |
| 5,879,191 | A | 3/1999 | Burris |
| 5,882,226 | A | 3/1999 | Bell et al. |
| 5,897,795 | A | 4/1999 | Lu et al. |
| 5,921,793 | A | 7/1999 | Phillips |
| 5,938,465 | A | 8/1999 | Fox, Sr. |
| 5,944,548 | A | 8/1999 | Saito |
| 5,951,327 | A | 9/1999 | Marik |
| 5,957,716 | A | 9/1999 | Buckley et al. |
| 5,967,852 | A | 10/1999 | Follingstad et al. |
| 5,975,949 | A | 11/1999 | Holliday et al. |
| 5,975,951 | A | 11/1999 | Burris et al. |
| 5,977,841 | A | 11/1999 | Lee et al. |
| 5,997,350 | A | 12/1999 | Burris et al. |
| 6,010,349 | A | 1/2000 | Porter, Jr. |
| 6,019,635 | A | 2/2000 | Nelson |
| 6,022,237 | A | 2/2000 | Esh |
| 6,032,358 | A | 3/2000 | Wild |
| 6,042,422 | A | 3/2000 | Youtsey |
| 6,048,229 | A | 4/2000 | Lazaro, Jr. |
| 6,053,743 | A | 4/2000 | Mitchell et al. |
| 6,053,769 | A | 4/2000 | Kubota et al. |
| 6,053,777 | A | 4/2000 | Boyle |
| 6,083,053 | A | 7/2000 | Anderson, Jr. et al. |
| 6,089,903 | A | 7/2000 | Stafford Gray et al. |
| 6,089,912 | A | 7/2000 | Tallis et al. |
| 6,089,913 | A | 7/2000 | Holliday |
| 6,123,567 | A | 9/2000 | McCarthy |
| 6,146,197 | A | 11/2000 | Holliday et al. |
| 6,152,753 | A | 11/2000 | Johnson et al. |
| 6,153,830 | A | 11/2000 | Montena |
| 6,162,995 | A | 12/2000 | Bachle et al. |
| 6,210,216 | B1 | 4/2001 | Tso-Chin et al. |
| 6,210,222 | B1 | 4/2001 | Langham et al. |
| 6,217,383 | B1 | 4/2001 | Holland et al. |
| 6,239,359 | B1 | 5/2001 | Lilienthal, II et al. |
| 6,241,553 | B1 | 6/2001 | Hsia |
| 6,257,923 | B1 | 7/2001 | Stone et al. |
| 6,261,126 | B1 | 7/2001 | Stirling |
| 6,267,612 | B1 | 7/2001 | Arcykiewicz et al. |
| 6,271,464 | B1 | 8/2001 | Cunningham |
| 6,331,123 | B1 | 12/2001 | Rodrigues |
| 6,332,815 | B1 | 12/2001 | Bruce |
| 6,358,077 | B1 | 3/2002 | Young |
| 6,383,019 | B1 | 5/2002 | Wild |
| D458,904 | S | 6/2002 | Montena |
| 6,406,330 | B2 | 6/2002 | Bruce |
| D460,739 | S | 7/2002 | Fox |
| D460,740 | S | 7/2002 | Montena |
| D460,946 | S | 7/2002 | Montena |
| D460,947 | S | 7/2002 | Montena |
| D460,948 | S | 7/2002 | Montena |
| 6,422,900 | B1 | 7/2002 | Hogan |
| 6,425,782 | B1 | 7/2002 | Holland |
| D461,166 | S | 8/2002 | Montena |
| D461,167 | S | 8/2002 | Montena |
| D461,778 | S | 8/2002 | Fox |

(56) References Cited

U.S. PATENT DOCUMENTS

| | | | |
|---|---|---|---|
| D462,058 | S | 8/2002 | Montena |
| D462,060 | S | 8/2002 | Fox |
| 6,439,899 | B1 | 8/2002 | Muzslay et al. |
| D462,327 | S | 9/2002 | Montena |
| 6,468,100 | B1 | 10/2002 | Meyer et al. |
| 6,491,546 | B1 | 12/2002 | Perry |
| D468,696 | S | 1/2003 | Montena |
| 6,506,083 | B1 | 1/2003 | Bickford et al. |
| 6,520,800 | B1 | 2/2003 | Michelbach et al. |
| 6,530,807 | B2 | 3/2003 | Rodrigues et al. |
| 6,540,531 | B2 | 4/2003 | Syed et al. |
| 6,558,194 | B2 | 5/2003 | Montena |
| 6,572,419 | B2 | 6/2003 | Feye-Homann |
| 6,576,833 | B2 | 6/2003 | Covaro et al. |
| 6,619,876 | B2 | 9/2003 | Vaitkus et al. |
| 6,634,906 | B1 | 10/2003 | Yeh |
| 6,676,446 | B2 | 1/2004 | Montena |
| 6,683,253 | B1 | 1/2004 | Lee |
| 6,692,285 | B2 | 2/2004 | Isalm |
| 6,692,286 | B1 | 2/2004 | De Cet |
| 6,705,884 | B1 | 3/2004 | McCarthy |
| 6,709,280 | B1 | 3/2004 | Gretz |
| 6,712,631 | B1 | 3/2004 | Youtsey |
| 6,716,041 | B2 | 4/2004 | Ferderer et al. |
| 6,716,062 | B1 | 4/2004 | Palinkas et al. |
| 6,733,336 | B1 | 5/2004 | Montena et al. |
| 6,733,337 | B2 | 5/2004 | Kodaira |
| 6,752,633 | B2 | 6/2004 | Aizawa et al. |
| 6,767,248 | B1 | 7/2004 | Hung |
| 6,769,926 | B1 | 8/2004 | Montena |
| 6,769,933 | B2 | 8/2004 | Bence et al. |
| 6,780,029 | B1 | 8/2004 | Gretz |
| 6,780,052 | B2 | 8/2004 | Montena et al. |
| 6,780,068 | B2 | 8/2004 | Bartholoma et al. |
| 6,786,767 | B1 | 9/2004 | Fuks et al. |
| 6,790,081 | B2 | 9/2004 | Burris et al. |
| 6,805,584 | B1 | 10/2004 | Chen |
| 6,817,896 | B2 | 11/2004 | Derenthal |
| 6,817,897 | B2 | 11/2004 | Chee |
| 6,848,939 | B2 | 2/2005 | Stirling |
| 6,848,940 | B2 | 2/2005 | Montena |
| 6,873,864 | B2 | 3/2005 | Kai et al. |
| 6,882,247 | B2 | 4/2005 | Allison et al. |
| 6,884,113 | B1 | 4/2005 | Montena |
| 6,884,115 | B2 | 4/2005 | Malloy |
| 6,898,940 | B2 | 5/2005 | Gram et al. |
| 6,916,200 | B2 | 7/2005 | Burris et al. |
| 6,926,508 | B2 | 8/2005 | Holland |
| 6,929,265 | B2 | 8/2005 | Holland et al. |
| 6,929,508 | B1 | 8/2005 | Holland |
| 6,939,169 | B2 | 9/2005 | Islam et al. |
| 6,948,976 | B2 | 9/2005 | Goodwin et al. |
| 6,971,912 | B2 | 12/2005 | Montena et al. |
| 7,004,788 | B2 | 2/2006 | Montena |
| 7,011,547 | B1 | 3/2006 | Wu |
| 7,029,304 | B2 | 4/2006 | Montena |
| 7,029,326 | B2 | 4/2006 | Montena |
| 7,063,565 | B2 | 6/2006 | Ward |
| 7,070,447 | B1 | 7/2006 | Montena |
| 7,074,081 | B2 | 7/2006 | Hsia |
| 7,086,897 | B2 | 8/2006 | Montena |
| 7,097,499 | B1 | 8/2006 | Purdy |
| 7,097,500 | B2 | 8/2006 | Montena |
| 7,102,668 | B2 | 9/2006 | Sasaki |
| 7,102,868 | B2 | 9/2006 | Montena |
| 7,108,548 | B2 | 9/2006 | Burris et al. |
| 7,114,990 | B2 | 10/2006 | Bence et al. |
| 7,118,416 | B2 | 10/2006 | Montena et al. |
| 7,125,283 | B1 | 10/2006 | Lin |
| 7,128,603 | B2 | 10/2006 | Burris et al. |
| 7,128,605 | B2 | 10/2006 | Montena |
| 7,131,686 | B1 | 11/2006 | Jo et al. |
| 7,131,867 | B1 | 11/2006 | Foster et al. |
| 7,131,868 | B2 | 11/2006 | Montena |
| 7,144,271 | B1 | 12/2006 | Burris et al. |
| 7,147,509 | B1 | 12/2006 | Burris et al. |
| 7,156,696 | B1 | 1/2007 | Montena |
| 7,161,785 | B2 | 1/2007 | Chawgo |
| 7,179,121 | B1 | 2/2007 | Burris et al. |
| 7,186,127 | B2 | 3/2007 | Montena |
| 7,189,113 | B2 | 3/2007 | Sattele et al. |
| 7,198,507 | B2 | 4/2007 | Tusini |
| 7,207,820 | B1 | 4/2007 | Montena |
| 7,229,303 | B2 | 6/2007 | Vermoesen et al. |
| 7,241,172 | B2 | 7/2007 | Rodrigues et al. |
| 7,252,546 | B1 | 8/2007 | Holland |
| 7,255,598 | B2 | 8/2007 | Montena et al. |
| 7,264,503 | B2 | 9/2007 | Montena |
| 7,299,520 | B2 | 11/2007 | Huang |
| 7,299,550 | B2 | 11/2007 | Montena |
| 7,300,309 | B2 | 11/2007 | Montena |
| 7,309,255 | B2 | 12/2007 | Rodrigues |
| 7,354,309 | B2 | 4/2008 | Palinkas |
| 7,371,112 | B2 | 5/2008 | Burris et al. |
| 7,371,113 | B2 | 5/2008 | Burris et al. |
| 7,375,533 | B2 | 5/2008 | Gale |
| 7,393,245 | B2 | 7/2008 | Palinkas et al. |
| 7,404,737 | B1 | 7/2008 | Youtsey |
| 7,442,081 | B2 | 10/2008 | Burke et al. |
| 7,452,237 | B1 | 11/2008 | Montena |
| 7,452,239 | B2 | 11/2008 | Montena |
| 7,455,549 | B2 | 11/2008 | Rodrigues et al. |
| 7,455,550 | B1 | 11/2008 | Sykes |
| 7,462,068 | B2 | 12/2008 | Amidon |
| 7,476,127 | B1 | 1/2009 | Wei |
| 7,479,033 | B1 | 1/2009 | Sykes et al. |
| 7,479,035 | B2 | 1/2009 | Bence et al. |
| 7,480,991 | B2 | 1/2009 | Khemakhem et al. |
| 7,488,210 | B1 | 2/2009 | Burris et al. |
| 7,494,355 | B2 | 2/2009 | Hughes et al. |
| 7,497,729 | B1 | 3/2009 | Wei |
| 7,507,117 | B2 | 3/2009 | Amidon |
| 7,513,795 | B1 | 4/2009 | Shaw |
| 7,544,094 | B1 | 6/2009 | Paglia et al. |
| 7,566,236 | B2 | 7/2009 | Malloy et al. |
| 7,568,945 | B2 | 8/2009 | Chee et al. |
| 7,607,942 | B1 | 10/2009 | Van Swearingen |
| 7,641,493 | B1 | 1/2010 | Lee |
| 7,644,755 | B2 | 1/2010 | Stoesz et al. |
| 7,674,132 | B1 | 3/2010 | Chen |
| 7,682,177 | B2 | 3/2010 | Berthet |
| 7,727,011 | B2 | 6/2010 | Montena et al. |
| 7,753,705 | B2 | 7/2010 | Montena |
| 7,753,727 | B1 | 7/2010 | Islam et al. |
| 7,792,148 | B2 | 9/2010 | Carlson et al. |
| 7,794,275 | B2 | 9/2010 | Rodrigues |
| 7,798,849 | B2 | 9/2010 | Montena |
| 7,806,714 | B2 | 10/2010 | Williams et al. |
| 7,806,725 | B1 | 10/2010 | Chen |
| 7,811,133 | B2 | 10/2010 | Gray |
| 7,824,216 | B2 | 11/2010 | Purdy |
| 7,828,595 | B2 | 11/2010 | Mathews |
| 7,828,596 | B2 | 11/2010 | Malak |
| 7,830,154 | B2 | 11/2010 | Gale |
| 7,833,053 | B2 | 11/2010 | Mathews |
| 7,837,501 | B2 | 11/2010 | Youtsey |
| 7,845,963 | B2 | 12/2010 | Gastineau |
| 7,845,976 | B2 | 12/2010 | Mathews |
| 7,845,978 | B1 | 12/2010 | Chen |
| 7,850,487 | B1 | 12/2010 | Wei |
| 7,857,661 | B1 | 12/2010 | Islam |
| 7,874,870 | B1 | 1/2011 | Chen |
| 7,887,354 | B2 | 2/2011 | Holliday |
| 7,892,004 | B2 | 2/2011 | Hertzler et al. |
| 7,892,005 | B2 | 2/2011 | Haube |
| 7,892,024 | B1 | 2/2011 | Chen |
| 7,927,135 | B1 | 4/2011 | Wlos |
| 7,934,954 | B1 | 5/2011 | Chawgo et al. |
| 7,950,958 | B2 | 5/2011 | Mathews |
| 7,955,126 | B2 | 6/2011 | Bence et al. |
| 7,972,158 | B2 | 7/2011 | Wild et al. |
| 8,029,315 | B2 | 10/2011 | Purdy et al. |
| 8,033,862 | B2 | 10/2011 | Radzik et al. |
| 8,062,044 | B2 | 11/2011 | Montena et al. |

(56) References Cited

U.S. PATENT DOCUMENTS

| | | | |
|---|---|---|---|
| 8,062,063 | B2 | 11/2011 | Malloy et al. |
| 8,075,337 | B2 | 12/2011 | Malloy et al. |
| 8,075,338 | B1 | 12/2011 | Montena |
| 8,075,339 | B2 | 12/2011 | Holliday |
| 8,079,860 | B1 | 12/2011 | Zraik |
| 8,113,875 | B2 | 2/2012 | Malloy et al. |
| 8,152,551 | B2 | 4/2012 | Zraik |
| 8,157,588 | B1 | 4/2012 | Rodrigues et al. |
| 8,157,589 | B2 | 4/2012 | Krenceski et al. |
| 8,167,635 | B1 | 5/2012 | Mathews |
| 8,167,636 | B1 | 5/2012 | Montena |
| 8,167,646 | B1 | 5/2012 | Mathews |
| 8,172,612 | B2 | 5/2012 | Bence et al. |
| 8,186,919 | B2 | 5/2012 | Blair |
| 8,192,237 | B2 | 6/2012 | Purdy et al. |
| 8,206,176 | B2 | 6/2012 | Islam |
| 8,231,406 | B2 | 7/2012 | Burris et al. |
| 8,231,412 | B2 | 7/2012 | Paglia et al. |
| 8,287,320 | B2 | 10/2012 | Purdy et al. |
| 8,313,345 | B2 | 11/2012 | Purdy |
| 8,313,353 | B2 | 11/2012 | Purdy et al. |
| 8,323,053 | B2 | 12/2012 | Montena |
| 8,323,060 | B2 | 12/2012 | Purdy et al. |
| 8,328,577 | B1 | 12/2012 | Lu |
| 8,337,229 | B2 | 12/2012 | Montena |
| 8,348,697 | B2 | 1/2013 | Zraik |
| 8,366,481 | B2 | 2/2013 | Ehret et al. |
| 8,376,769 | B2 | 2/2013 | Holland et al. |
| 8,382,517 | B2 | 2/2013 | Mathews |
| 8,398,421 | B2 | 3/2013 | Haberek et al. |
| 8,414,322 | B2 | 4/2013 | Montena |
| 8,444,445 | B2 | 5/2013 | Amidon et al. |
| 8,469,740 | B2 | 6/2013 | Ehret et al. |
| 8,475,205 | B2 | 7/2013 | Ehret et al. |
| 8,480,430 | B2 | 7/2013 | Ehret et al. |
| 8,480,431 | B2 | 7/2013 | Ehret et al. |
| 8,485,845 | B2 | 7/2013 | Ehret et al. |
| 8,506,325 | B2 | 8/2013 | Malloy et al. |
| 8,517,763 | B2 | 8/2013 | Burris et al. |
| 8,529,279 | B2 | 9/2013 | Montena |
| 8,562,366 | B2 | 10/2013 | Purdy et al. |
| 8,597,041 | B2 | 12/2013 | Purday et al. |
| 8,888,526 | B2 | 11/2014 | Burris |
| 9,166,348 | B2 | 10/2015 | Burris et al. |
| 9,172,154 | B2 | 10/2015 | Burris |
| 2002/0013088 | A1 | 1/2002 | Rodrigues et al. |
| 2002/0038720 | A1 | 4/2002 | Kai et al. |
| 2003/0068924 | A1 | 4/2003 | Montena |
| 2003/0214370 | A1 | 11/2003 | Allison et al. |
| 2003/0224657 | A1 | 12/2003 | Malloy |
| 2004/0013096 | A1 | 1/2004 | Marinier et al. |
| 2004/0077215 | A1 | 4/2004 | Palinkas et al. |
| 2004/0102089 | A1 | 5/2004 | Chee |
| 2004/0209516 | A1 | 10/2004 | Burris et al. |
| 2004/0219833 | A1 | 11/2004 | Burris et al. |
| 2004/0229504 | A1 | 11/2004 | Liu |
| 2005/0042919 | A1 | 2/2005 | Montena |
| 2005/0079762 | A1 | 4/2005 | Hsia |
| 2005/0159045 | A1 | 7/2005 | Huang |
| 2005/0208827 | A1 | 9/2005 | Burris et al. |
| 2005/0233636 | A1 | 10/2005 | Rodrigues et al. |
| 2006/0099853 | A1 | 5/2006 | Sattele et al. |
| 2006/0110977 | A1 | 5/2006 | Matthews |
| 2006/0154519 | A1 | 7/2006 | Montena |
| 2006/0166552 | A1 | 7/2006 | Bence et al. |
| 2006/0205272 | A1 | 9/2006 | Rodgrguies |
| 2006/0276079 | A1 | 12/2006 | Chen |
| 2007/0026734 | A1 | 2/2007 | Bence et al. |
| 2007/0049113 | A1 | 3/2007 | Rodrigues et al. |
| 2007/0123101 | A1 | 5/2007 | Palinkas |
| 2007/0155232 | A1 | 7/2007 | Burris et al. |
| 2007/0175027 | A1 | 8/2007 | Khemakhem et al. |
| 2007/0243759 | A1 | 10/2007 | Rodrigues et al. |
| 2007/0243762 | A1 | 10/2007 | Burke et al. |
| 2008/0102696 | A1 | 5/2008 | Montena |
| 2008/0192674 | A1 | 8/2008 | Wang et al. |
| 2008/0225783 | A1 | 9/2008 | Wang et al. |
| 2008/0248689 | A1 | 10/2008 | Montena |
| 2008/0289470 | A1 | 11/2008 | Aston |
| 2009/0017803 | A1 | 1/2009 | Brilhart et al. |
| 2009/0029590 | A1 | 1/2009 | Sykes et al. |
| 2009/0098770 | A1 | 4/2009 | Bence et al. |
| 2009/0163075 | A1 | 6/2009 | Blew et al. |
| 2009/0176396 | A1 | 7/2009 | Mathews |
| 2009/0186521 | A1 | 7/2009 | McMullen et al. |
| 2010/0055978 | A1 | 3/2010 | Montena |
| 2010/0081321 | A1 | 4/2010 | Malloy et al. |
| 2010/0081322 | A1 | 4/2010 | Malloy et al. |
| 2010/0105246 | A1 | 4/2010 | Burris et al. |
| 2010/0233901 | A1 | 9/2010 | Wild et al. |
| 2010/0233902 | A1 | 9/2010 | Youtsey |
| 2010/0255720 | A1 | 10/2010 | Radzik et al. |
| 2010/0255721 | A1 | 10/2010 | Purdy |
| 2010/0279548 | A1 | 11/2010 | Montena et al. |
| 2010/0297871 | A1 | 11/2010 | Haube |
| 2010/0297875 | A1 | 11/2010 | Purdy et al. |
| 2011/0021072 | A1 | 1/2011 | Purdy |
| 2011/0027039 | A1 | 2/2011 | Blair |
| 2011/0053413 | A1 | 3/2011 | Mathews |
| 2011/0086543 | A1 | 4/2011 | Alrutz |
| 2011/0111623 | A1 | 5/2011 | Burris et al. |
| 2011/0117774 | A1 | 5/2011 | Malloy et al. |
| 2011/0143567 | A1 | 6/2011 | Purdy et al. |
| 2011/0230089 | A1 | 9/2011 | Amidon et al. |
| 2011/0230091 | A1 | 9/2011 | Krenceski et al. |
| 2011/0250789 | A1 | 10/2011 | Burris et al. |
| 2012/0021642 | A1 | 1/2012 | Zraik |
| 2012/0040537 | A1 | 2/2012 | Burris |
| 2012/0045933 | A1 | 2/2012 | Youtsey |
| 2012/0094530 | A1 | 4/2012 | Montena |
| 2012/0094532 | A1 | 4/2012 | Montena |
| 2012/0122329 | A1 | 5/2012 | Montena |
| 2012/0129387 | A1 | 5/2012 | Holland et al. |
| 2012/0145454 | A1 | 6/2012 | Montena |
| 2012/0171894 | A1 | 7/2012 | Malloy et al. |
| 2012/0196476 | A1 | 8/2012 | Haberek et al. |
| 2012/0202378 | A1 | 8/2012 | Krenceski et al. |
| 2012/0214342 | A1 | 8/2012 | Mathews |
| 2012/0222302 | A1 | 9/2012 | Purdy et al. |
| 2012/0225581 | A1 | 9/2012 | Amidon et al. |
| 2012/0252263 | A1 | 10/2012 | Ehret et al. |
| 2012/0270441 | A1 | 10/2012 | Bence et al. |
| 2013/0034983 | A1 | 2/2013 | Purdy et al. |
| 2013/0065433 | A1 | 3/2013 | Burris |
| 2013/0065435 | A1 | 3/2013 | Purdy et al. |
| 2013/0072059 | A1 | 3/2013 | Purdy et al. |
| 2013/0102188 | A1 | 4/2013 | Montena |
| 2013/0102189 | A1 | 4/2013 | Montena |
| 2013/0102190 | A1 | 4/2013 | Chastain et al. |
| 2013/0164975 | A1 | 6/2013 | Blake et al. |
| 2013/0171869 | A1 | 7/2013 | Chastain et al. |
| 2013/0171870 | A1 | 7/2013 | Chastain et al. |
| 2013/0183857 | A1 | 7/2013 | Ehret et al. |
| 2013/0337683 | A1 | 12/2013 | Chastain et al. |
| 2014/0051285 | A1 | 2/2014 | Raley et al. |

FOREIGN PATENT DOCUMENTS

| | | | |
|---|---|---|---|
| CN | 201149337.00 | Y | 11/2008 |
| CN | 201149936.00 | Y | 11/2008 |
| CN | 201178228.00 | Y | 1/2009 |
| CN | 201904508.00 | | 7/2011 |
| DE | 47931.00 | C | 10/1888 |
| DE | 102289.00 | C | 4/1899 |
| DE | 1117687.00 | B | 11/1961 |
| DE | 1191880.00 | | 4/1965 |
| DE | 1515398.00 | B1 | 4/1970 |
| DE | 2225764.00 | A1 | 12/1972 |
| DE | 2221936.00 | A1 | 11/1973 |
| DE | 2261973.00 | A1 | 6/1974 |
| DE | 3211008.00 | A1 | 10/1983 |
| DE | 9001608.40 | U1 | 4/1990 |
| DE | 4439852.00 | A1 | 5/1996 |
| DE | 19957518.00 | A1 | 9/2001 |

(56) References Cited

FOREIGN PATENT DOCUMENTS

| | | | |
|---|---|---|---|
| EP | 116157.00 | A1 | 8/1984 |
| EP | 167738.00 | A2 | 1/1986 |
| EP | 0072104 | A1 | 2/1986 |
| EP | 0265276 | A2 | 4/1988 |
| EP | 0428424 | A2 | 5/1991 |
| EP | 1191268.00 | A1 | 3/2002 |
| EP | 1501159.00 | A1 | 1/2005 |
| EP | 1548898.00 | A1 | 6/2005 |
| EP | 1701410.00 | A2 | 9/2006 |
| EP | 2242147 | A1 | 10/2010 |
| FR | 2232846.00 | A1 | 1/1975 |
| FR | 2234680.00 | A2 | 1/1975 |
| FR | 2312918.00 | | 12/1976 |
| FR | 2462798.00 | A1 | 2/1981 |
| FR | 294508.00 | A1 | 5/1982 |
| GB | 589697.00 | A | 6/1947 |
| GB | 1087228.00 | A | 10/1967 |
| GB | 1270846.00 | A | 4/1972 |
| GB | 1401373.00 | A | 7/1975 |
| GB | 2019665.00 | A | 10/1979 |
| GB | 2079549.00 | A | 1/1982 |
| GB | 2252677.00 | A | 8/1992 |
| GB | 2264201.00 | A | 8/1993 |
| GB | 2331634.00 | A | 5/1999 |
| GB | 2477479.00 | | 8/2010 |
| JP | 2002-015823 | | 1/2001 |
| JP | 3074864.00 | | 1/2001 |
| JP | 4503793.00 | B9 | 1/2002 |
| JP | 2002075556.00 | A | 3/2002 |
| JP | 2001102299.00 | | 4/2002 |
| JP | 3280369.00 | B2 | 5/2002 |
| KR | 100622526 | B1 | 9/2006 |
| TW | 427044.00 | B | 3/2001 |
| WO | 8700351 | | 1/1987 |
| WO | 0186756 | A1 | 11/2001 |
| WO | 02069457 | A1 | 9/2002 |
| WO | 2004013883 | A2 | 2/2004 |
| WO | 2006081141 | A1 | 8/2006 |
| WO | WO 2010-141880 | A1 | 9/2010 |
| WO | 2010135181 | | 11/2010 |
| WO | 2011128665 | A1 | 10/2011 |
| WO | 2011128666 | A1 | 10/2011 |
| WO | 2012061379 | A2 | 5/2012 |

OTHER PUBLICATIONS

LIT13; *PPC Broadband, Inc., d/b/a PPC*, v. *PCT International, Inc.*, USDC, Northern District of New York, Case No. 5:13-cv-0135-GTS-DEP, Defendant PCT International, Inc.'s Disclosure of Preliminary Non-Infringement, Invalidity, and Unenforceability Contentions Filed Jul. 29, 2013. 86 pages.

LIT14; *PPC Broadband, Inc., d/b/a PPC*, v. *PCT International, Inc.*, USDC, Northern District of New York, Case No. 5:13-cv-0135-GTS-DEP, Defendant PCT International, Inc.'s Supplemental Disclosure of Preliminary Non-Infringement, Invalidity, and Unenforceability Contentions Filed Nov. 26, 2013. 14 pages.

LIT14B; *PPC Broadband, Inc., d/b/a PPC*, v. *PCT International, Inc.*, USDC, Northern District of New York, Case No. 5:13-cv-0135-GTS-DEP, Defendant PCT International, Inc.'s Supplemental Disclosure of Preliminary Non-Infringement, Invalidity, and Unenforceability Contentions Filed Nov. 26, 2013, Exhibits B1-B6. 68 pages.

LIT14C; *PPC Broadband, Inc., d/b/a PPC*, v. *PCT International, Inc.*, USDC, Northern District of New York, Case No. 5:13-cv-0135-GTS-DEP, Defendant PCT International, Inc.'s Supplemental Disclosure of Preliminary Non-Infringement, Invalidity, and Unenforceability Contentions Filed Nov. 26, 2013, Exhibits C1-C4. 122 pages.

LIT15; *PerfectVision Manufacturing, Inc.* v. *PPC Broadband, Inc., d/b/a PPC*, USDC Eastern District of Arkansas Western Division, Case No. 4-12-CV-623-JLH, Plaintiff's Invalidity Contentions—U. S. Pat. No. 8,366,481. 96 pages.

LIT15B; *PerfectVision Manufacturing, Inc.* v. *PPC Broadband, Inc., d/b/a PPC*, USDC Eastern District of Arkansas Western Division, Case No. 4-12-CV-623-JLH, Plaintiffs Invalidity Contentions—U.S. Pat. No. 8,469,740. 78 pages.

LIT15C; *PerfectVision Manufacturing, Inc.* v. *PPC Broadband, Inc., d/b/a PPC*, USDC Eastern District of Arkansas Western Division, Case No. 4-12-CV-623-JLH, Plaintiffs Invalidity Contentions-U.S. Pat. No. 8,475,205. 236 pages.

LIT15D; *PerfectVision Manufacturing, Inc.* v. *PPC Broadband, Inc., d/b/a PPC*, USDC Eastern District of Arkansas Western Division, Case No. 4-12-CV-623-JLH, Plaintiffs Invalidity Contentions-U.S. Pat. No. 8,480,430. 189 pages.

LIT15E;*PerfectVision Manufacturing, Inc.* v. *PPC Broadband, Inc., d/b/a PPC*, USDC Eastern District of Arkansas Western Division, Case No. 4-12-CV-623-JLH, Plaintiff's Invalidity Contentions-U.S. Pat. No. 8,480,431. 73 pages.

LIT15F;*PerfectVision Manufacturing, Inc.* v. *PPC Broadband, Inc., d/b/a PPC*, USDC Eastern District of Arkansas Western Division, Case No. 4-12-CV-623-JLH, Plaintiff's Invalidity Contentions-U.S. Pat. No. 8,485,845. 73 pages.

ARRIS1; Digicon AVL Connector. ARRIS Group Inc. [online]. 3 pages. [retrieved on Apr. 22, 2010]. Retrieved from the Internet<URL: http://www.arrisi.com/special/digiconAVL.asp>.

ISR1; PCT/US2011/057939 Date of Mailing: Apr. 30, 2012 International Search Report and Written Opinion. pp. 8.

LIT16; Report and Recommendation, Issued Dec. 5, 2013, *John Mezzalingua Associates, Inc., d/b/a PPC*, v. *Corning Gilbert, Inc.*, United States District Court Northern District of New York, Civil Action No. 5:12-CV-00911-GLS-DEP, 52 pages.

NOA1; Notice of Allowance (Mail Date: Feb. 24, 2012) for U.S. Appl. No. 13/033,127, filed Feb. 23, 2011.

NOA2; Notice of Allowance (Mail Date: Jan. 24, 2013) for U.S. Appl. No. 13/072,350.

NOA3; Notice of Alowance (Date mailed: Jun. 25, 2012) for U.S. Appl. No. 12/633,792, filed Dec. 8, 2009.

NOA4; Notice of Allowance (Mail Date Mar. 20, 2012) for U.S. Appl. No. 13/117,843, filed May 27, 2011.

OA1; Office Action mail date Mar. 29, 2013 for U.S. Appl. No. 13/712,470.

OA10; Final Office Action (Mail Date: Oct. 25, 2011) for U.S. Appl. No. 13/033,127, filed Feb. 23, 2011.

OA11; Office Action (Mail Date: Oct. 24, 2011) for U.S. Appl. No. 12/633,792, filed Dec. 8, 2009.

OA2; Office Action (Mail Date Mar. 6, 2013) for U.S. Appl. No. 13/726,330, filed Dec. 24, 2012.

OA3; Office Action (Mail Date Feb. 20, 2013) for U.S. Appl. No. 13/726,349, filed Dec. 24, 2012.

OA4; Office Action (Mail Date Feb. 20, 2013) for U.S. Appl. No. 13/726,339 filed Dec. 24, 2012.

OA5; Office Action (Mail Date Mar. 11, 2013) for U.S. Appl. No. 13/726,347, filed Dec. 24, 2012.

OA6; Office Action (Mail Date Feb. 20, 2013) for U.S. Appl. No. 13/726,356, filed Dec. 24, 2012.

OA7; Office Action (mail date Apr. 12, 2013) for U.S. Appl. No. 13/712,498, filed Dec. 12, 2012.

OA8; Office Action (mail date Jun. 11, 2013) for U.S. Appl. No. 13/860,964, filed Apr. 11, 2013.

OA9; Office Action (Mail Date: Jun. 2, 2011) for U.S. Appl. No. 13/033,127, filed Feb. 23, 2011.

RES1; Response dated Jun. 24, 2011 to Office Action (Mail Date: Jun. 2, 2011) for U.S. Appl. No. 13/033,127, filed Feb. 23, 2011.

TECHDOC1; Philips, NXP, "PDCCH message information content for persistent scheduling," R1-081506, Agenda Item: 6.1.3, 3GPP TSG RAN WG1 Meeting #52bis, Shenzhen, China, Mar. 31-Apr. 4, 2008, 3 pages.

TECHDOC10; PPC Product Guide, 2008.

TECHDOC2; NTT DoCoMo, Inc. "UL semi-persistent resource deactivation," R2-082483 (resubmission of R2-081859), Agenda Item: 5.1.1.8, 3GPP TSG RAN WG2 #62, Kansas City, MO, USA, May 5-9, 2008, 2 pages.

TECHDOC3; Panasonic, "Configuration for semi-persistent scheduling," R2-081575, Agenda Item: 5.1.1.8, 3GPP TSG RAN WG2 #61bis, Shenzhen, China, Mar. 31-Apr. 4, 2008, 4 pages.

(56) References Cited

OTHER PUBLICATIONS

TECHDOC4; Panasonic, "Remaining issues on Persistent scheduling," R2-083311, derived from R2-082228 and R2-082229, Agenda Item: 6.1.1.8, 3GPP TSG RAN WG2 #62bis, Warsaw, Poland, Jun. 30-Jul. 4, 2008, 4 pages.
TECHDOC7; Nokia Corporation, Nokia Siemens Networks, "Persistent Scheduling for DL," R2-080683 (RS-080018), 3GPP TAG-RAN WG2 Meeting #61, Agenda Item: 5.1.1.8, Sorrento, Italy, Feb. 11-15, 2008, 6 pages.
TECHDOC8; Panasonic, "SPS activation and release," R1-084233, 3GPP TSG-RAN WG1 Meeting #55, Prague, Czech Republic, Nov. 10-14, 2008, 6 pages.
TECHDOC9; PCT International, Inc., Compression Connectors Installation Guide, Aug. 3, 2009.
TechDoc11; NTT DoCoMo, Alcatel, Cingular Wireless, CMCC, Ericsson, Fujitsu, Huawei, LG Electronics, Lucent Technologies, Mitsubishi Electric, Motorola, NEC, Nokia, Nortel Networks, Orange, Panasonic, Philips, Qualcomm Europe, Samsung, Sharp Siemens, Telecom Italia, Telefonica, TeliaSonera, T-Mobile, Vodafone, "Proposed Study Item on Evolved UTRA and UTRAN," RP-040461, Agenda Item: 8.12, TSG-RAN Meeting #26, Athens, Greece, Dec. 8-10, 2004, 5 pages.
TECHSPEC1A; "3rd Generation Partnership Project; Technical Specification Group Radio Access Network; Requirements for Evolved UTRA (E-UTRA) and Evolved UTRAN (E-UTRAN) (Release 7)," Technical Report, 3GPP TR 125.913 V7.3.0, Mar. 2006, 18 pages.
TECHSPEC2A; "3rd Generation Partnership Project; Technical Specification Group Radio Access Network; Evolved Universal Terrestrial Radio Access (E-UTRA) and Evolved Universal Terrestrial Radio Access Network (E-UTRAN); Overall description; Stage 2 (Release 8)," Technical Specification, 3GPP TS 36.300 V8.5.0, May 2008, 134 pages.
TECHSPEC3A; "3rd Generation Partnership Project; Technical Specification Group Radio Access Network; Evolved Universal Terrestrial Radio Access (E-UTRA) Medium Access Control (MAC) protocol specification (Release 8)," Technical Specification, 3GPP TS 36.321 V8.2.0, May 2008, 32 pages.
TECHSPEC4A; "3rd Generation Partnership Project; Technical Specification Group Radio Access Netowrk; Evolved Universal Terrestrial Radio Access (E-UTRA); Physical layer procedures (Release 8)," Technical Specification, 3GPP TS 36.213 V8.4.0, Sep. 2008, 60 pages.
TECHSPEC5A; Society of Cable Telecommunications Engineers, Engineering Committee, Interface Practices Subcommittee; American National Standard; ANSI/SCTE 01 2006; "Specification for "F" Port, Female, Outdoor". Published Jan. 2006. 9 pages.
TECHSPEC6A; Society of Cable Telecommunications Engineers, Engineering Committee, Interface Practices Subcommittee; American National Standard; ANSI/SCTE 02 2006; "Specification for "F" Port, Female, Indoor". Published Feb. 2006. 9 pages.
Patent Application No. GB1109575.9 Examination Report Under Section 18(3); Date of Report: Jun. 23, 2011. 3 pp.
Patent No. ZL2010202597847; Evaluation Report of Utility Model Patent; Date of Report; Sep. 2, 2011. (Chinese version with English Traslation (10 pages) provided).
PCT/US2010/034870; International Filing Date May 14, 2010. International Search Report and Written Opinion. Date of Mailing: Nov. 30, 2010. 7 pages.
*PPC Broadband, Inc., d/b/a PPC*, v. *PCT International, Inc.*, USDC, Northern District of New York, Case No. 5:13-cv-0135-GTS-DEP, Defendant PCT International, Inc.'s Disclosure of Preliminary Non-Infringement, Invalidity, and Unenforceability Contentions Filed Jul. 29, 2013. 86 pages.
*PPC Broadband, Inc., d/b/a PPC*, v. *PCT International, Inc.*, USDC, Northern District of New York, Case No. 5:13-cv-0135-GTS-DEP, Defendant PCT International, Inc.'s Supplemental Disclosure of Preliminary Non-Infringement, Invalidity, and Unenforceability Contentions Filed Nov. 26, 2013. 14 pages.
*PPC Broadband, Inc., d/b/a PPC*, v. *PCT International, Inc.*, USDC, Northern District of New York, Case No. 5:13-cv-0135-GTS-DEP, Defendant PCT International, Inc.'s Supplemental Disclosure of Preliminary Non-Infringement, Invalidity, and Unenforceability Contentions Filed Nov. 26, 2013, Exhibits B1-B6. 68 pages.
*PPC Broadband, Inc., d/b/a PPC*, v. *PCT International, Inc.*, USDC, Northern District of New York, Case No. 5:13-cv-0135-GTS-DEP, Defendant PCT International, Inc.'s Supplemental Disclosure of Preliminary Non-Infringement, Invalidity, and Unenforceability Contentions Filed Nov. 26, 2013, Exhibits C1-C4. 122 pages.
*PerfectVision Manufacturing, Inc.* v. *PPC Broadband, Inc., d/b/a PPC*, USDC Eastern District of Arkansas Western Division, Case No. 4-12-Cv-623-JLH, Plaintiffs Invalidity Contentions-U.S. Pat. No. 8,366,481. 96 pages.
*PerfectVision Manufacturing, Inc.* v. *PPC Broadband, Inc., d/b/a PPC*, USDC Eastern District of Arkansas Western Division, Case No. 4-12-CV-623-JLH, Plaintiffs Invalidity Contentions-U.S. Pat. No. 8,469,740. 78 pages.
*PerfectVision Manufacturing, Inc.* v. *PPC Broadband, Inc., d/b/a PPC*, USDC Eastern District of Arkansas Western Division, Case No. 4-12-CV-623-JLH, Plaintiffs Invalidity Contentions-U.S. Pat. No. 8,475,205. 236 pages.
*PerfectVision Manufacturing, Inc.* v. *PPC Broadband, Inc., d/b/a PPC*, USDC Eastern District of Arkansas Western Division, Case No. 4-12-CV-623-JLH, Plaintiffs Invalidity Contentions-U.S. Pat. No. 8,480,430. 189 pages.
*PerfectVision Manufacturing, Inc.* v. *PPC Broadband, Inc., d/b/a PPC*, USDC Eastern District of Arkansas Western Division, Case No. 4-12-CV-623-JLH, Plaintiffs Invalidity Contentions-U.S. Pat. No. 8,480,431. 73 pages.
*PerfectVision Manufacturing, Inc.* v. *PPC Broadband, Inc., d/b/a PPC*, USDC Eastern District of Arkansas Western Division, Case No. 4-12-CV-623-JLH, Plaintiffs Invalidity Contentions-U.S. Pat. No. 8,485,845. 73 pages.
Corning Optical Communications RF LLC, U.S. Appl. No. 13/084,099, filed Apr. 11, 2011, US Patent Application and File History.
USPTO, Non-Final Office Action mailed Jul. 2, 2015 in U.S. Appl. No. 13/913,043, filed Jun. 7, 2013 (US Pub. No. US 2013-0273761 published Oct. 17, 2013.).
European Patent Office, Extended European Search Report from EP Appl. No. 15179665.3-1801 dated Nov. 25, 2015 (total 12 pages).
Petition for Inter Partes Review Case IPR2016-01570—U.S. Pat. No. 8,366,481 (Claims 1, 3-7 and 14-16) under 35 USC §§ 311-319 and 37 CFR § 42.100, filed Aug. 9, 2016 (total 83 pages).
Petition for Inter Partes Review Case IPR2016-01572—U.S. Pat. No. 8,366,481 (Claims 1, 3-7 and 14-16) under 35 USC §§ 311-319 and 37 CFR § 42.100, filed Aug. 9, 2016 (total 79 pages).

CONNECTOR PRODUCING A BIASING FORCE

PRIORITY CLAIM

This application is a continuation of, and claims the benefit and priority of, U.S. patent application Ser. No. 13/913,043, filed on Jun. 7, 2013, which is a continuation of, and claims the benefit and priority of, U.S. patent application Ser. No. 13/726,330, filed on Dec. 24, 2012, now U.S. Pat. No. 8,480,430, which is a continuation of, and claims the benefit and priority of, U.S. patent application Ser. No. 13/075,406, filed on Mar. 30, 2011, now U.S. Pat. No. 8,366,481.

CROSS REFERENCE TO RELATED APPLICATIONS

This application is related to the following commonly-owned, patent applications; (a) U.S. patent application Ser. No. 13/712,470, filed on Dec. 12, 2012, now U.S. Pat. No. 8,920,192; (b) U.S. patent application Ser. No. 13/758,586, filed on Feb. 4, 2013, now U.S. Pat. No. 9,017,101; (c) U.S. patent application Ser. No. 13/971,147, filed on Aug. 20, 2013, now U.S. Pat. No. 8,801,448; (d) U.S. patent application Ser. No. 14/092,103, filed on Nov. 27, 2013, now U.S. Pat. No. 8,920,182; (e) U.S. patent application Ser. No. 14/092,003, filed on Nov. 27, 2013; now U.S. Pat. No. 8,915,754; (f) U.S. patent application Ser. No. 14/091,875; filed on Nov. 27, 2013, now U.S. Pat. No. 8,858,251; (g) U.S. patent application Ser. No. 14/134,892, filed on Dec. 19, 2013; (h) U.S. patent application Ser. No. 14/104,463, filed on Dec. 12, 2013, now U.S. Pat. No. 9,419,389; (i) U.S. patent application Ser. No. 14/104,363, filed on Dec. 12, 2013, now U.S. Pat. No. 9,511,447; and (j) U.S. patent application Ser. No. 14/173,355, filed on Feb. 5, 2014.

FIELD OF TECHNOLOGY

The following relates to connectors used in coaxial cable communication applications, and more specifically to embodiments of a connector having a biasing member for maintaining continuity through a connector.

BACKGROUND

Connectors for coaxial cables are typically connected onto complementary interface ports to electrically integrate coaxial cables to various electronic devices. Maintaining continuity through a coaxial cable connector typically involves the continuous contact of conductive connector components which can prevent radio frequency (RF) leakage and ensure a stable ground connection. In some instances, the coaxial cable connectors are present outdoors, exposed to weather and other numerous environmental elements. Weathering and various environmental elements can work to create interference problems when metallic conductive connector components corrode, rust, deteriorate or become galvanically incompatible, thereby resulting in intermittent contact, poor electromagnetic shielding, and degradation of the signal quality. Moreover, some metallic connector components can permanently deform under the torque requirements of the connector mating with an interface port. The permanent deformation of a metallic connector component results in intermittent contact between the conductive components of the connector and a loss of continuity through the connector.

Thus, a need exists for an apparatus and method for ensuring continuous contact between conductive components of a connector.

SUMMARY

A first general aspect relates to a coaxial cable connector comprising a post having a first end, a second end, and a flange proximate the second end, wherein the post is configured to receive a center conductor surrounded by a dielectric of a coaxial cable, a connector body attached to the post, a coupling element attached to the post, the coupling element having a first end and a second end, and a biasing member disposed within a cavity formed between the first end of the coupling element and the connector body to bias the coupling element against the post.

A second general aspect relates to a coaxial cable connector comprising a post having a first end, a second end, and a flange proximate the second end, wherein the post is configured to receive a center conductor surrounded by a dielectric of a coaxial cable, a coupling element attached to the post, the coupling element having a first end and a second end, and a connector body having a biasing element, wherein the biasing element biases the coupling element against the post.

A third general aspect relates to a coaxial cable connector comprising a post having a first end, a second end, and a flange proximate the second end, wherein the post is configured to receive a center conductor surrounded by a dielectric of a coaxial cable, a connector body attached to the post, a coupling element attached to the post, the coupling element having a first end and a second end, and a means for biasing the coupling element against the post, wherein the means does not hinder rotational movement of the coupling element.

A fourth general aspect relates to a method of facilitating continuity through a coaxial cable connector, comprising providing a post having a first end, a second end, and a flange proximate the second end, wherein the post is configured to receive a center conductor surrounded by a dielectric of a coaxial cable, a connector body attached to the post, and a coupling element attached to the post, the coupling element having a first end and a second end, and disposing a biasing member within a cavity formed between the first end of the coupling element and the connector body to bias the coupling element against the post.

A fifth general aspect relates to a method of facilitating continuity through a coaxial cable connector, comprising providing a post having a first end, a second end, and a flange proximate the second end, wherein the post is configured to receive a center conductor surrounded by a dielectric of a coaxial cable, a coupling element attached to the post, the coupling element having a first end and a second end, and a connector body having a first end, a second end, and an annular recess proximate the second end of the connector body, extending the annular recess a radial distance to engage the coupling element, wherein the engagement between the extended annular recess and the coupling element biases the coupling element against the post.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1A:
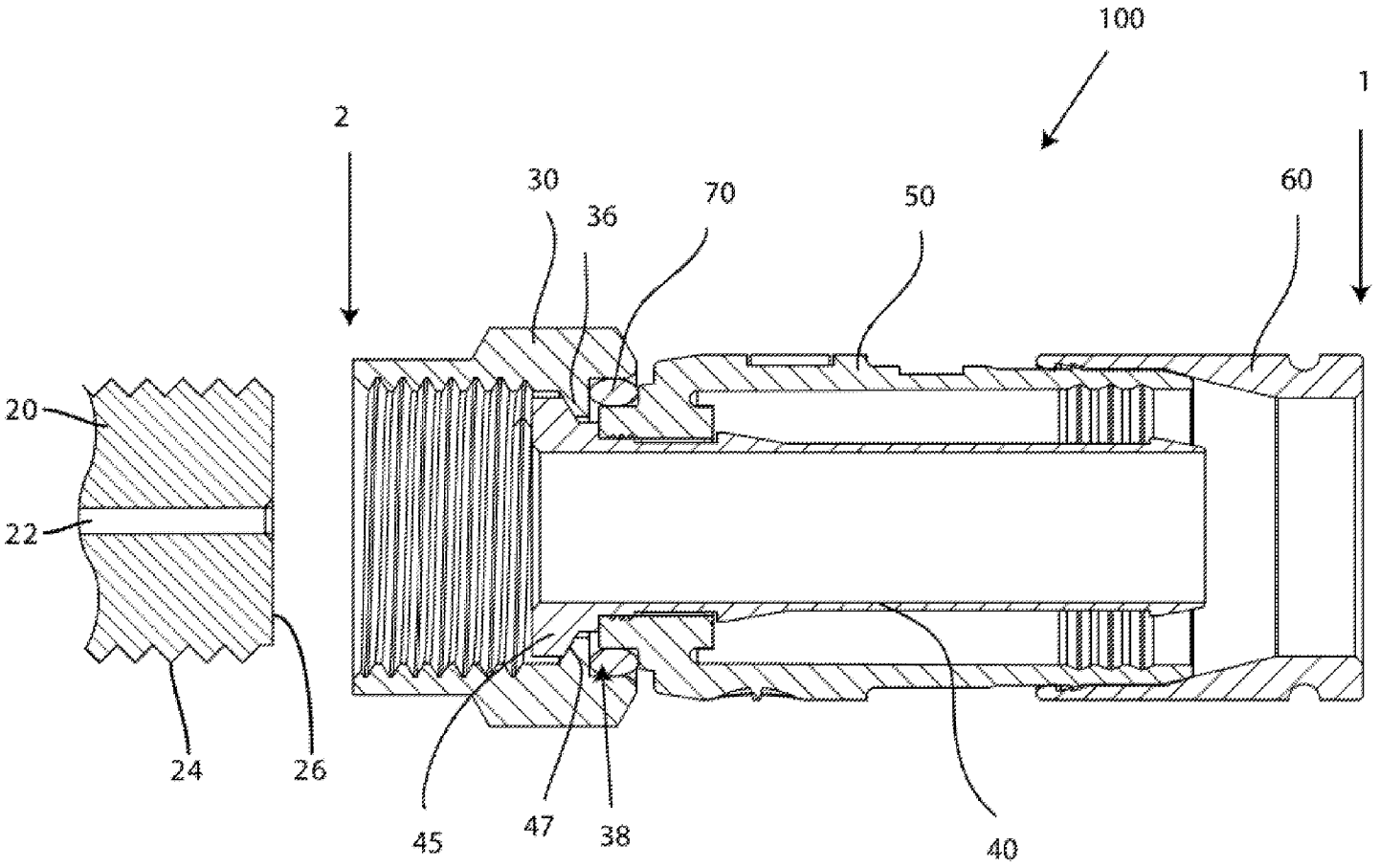
FIG. 1A depicts a cross-sectional view of a first embodiment of a coaxial cable connector.
Figure 1B:
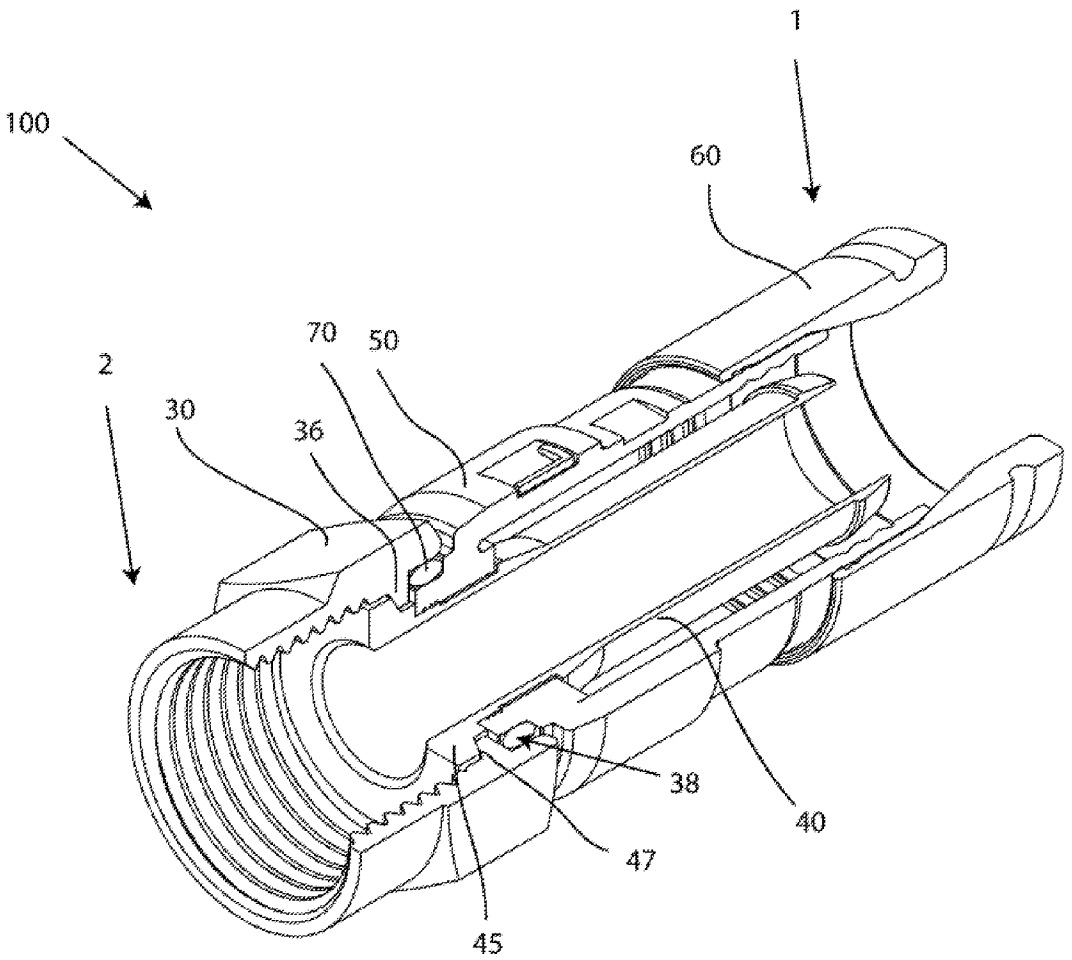
FIG. 1B depicts a perspective cut-away view of the first embodiment of a coaxial cable connector.

Referring to the drawings, FIG. 1 depicts an embodiment of a coaxial cable connector 100. A coaxial cable connector embodiment 100 has a first end 1 and a second end 2, and can be provided to a user in a preassembled configuration to ease handling and installation during use. Coaxial cable connector 100 may be an F connector, or similar coaxial cable connector. Furthermore, the connector 100 includes a post 40 configured for receiving a prepared portion of a coaxial cable 10.

Figure 2:
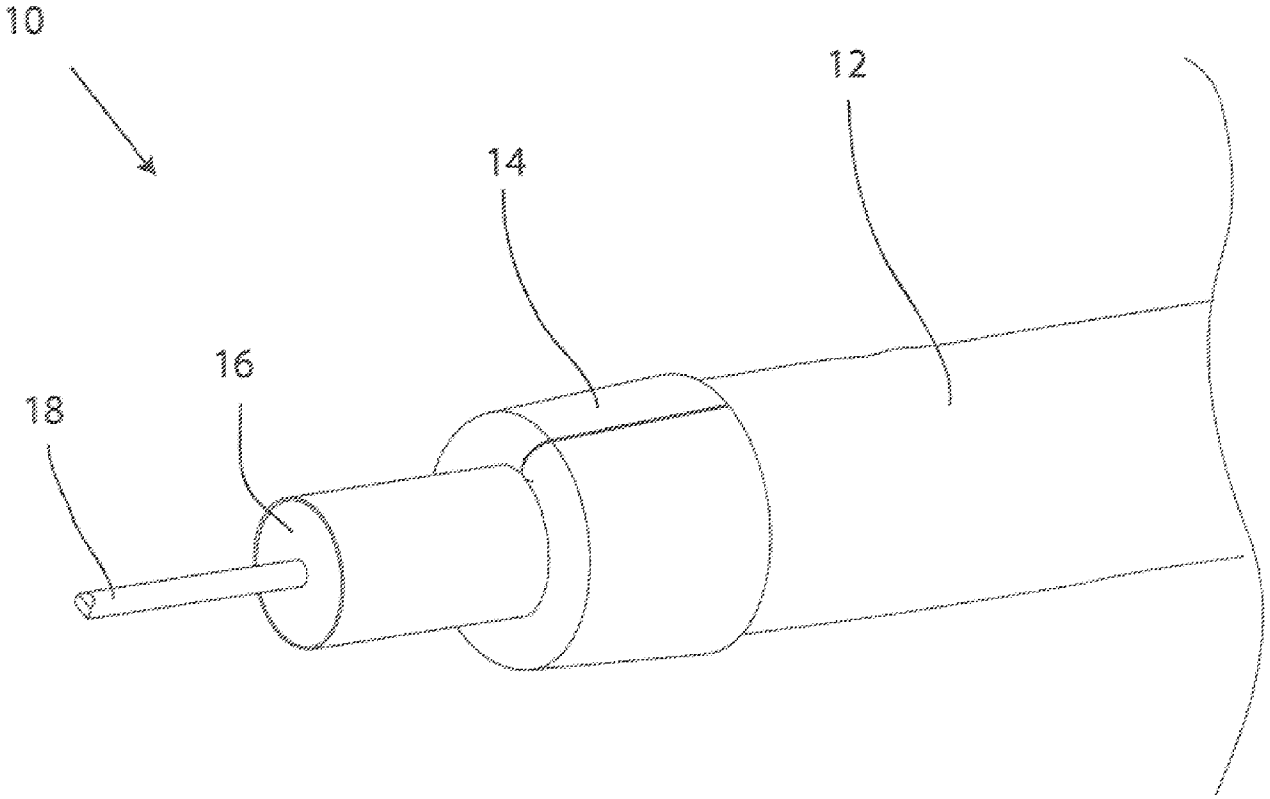
FIG. 2 depicts a perspective view of an embodiment of a coaxial cable.

Referring now to FIG. 2, the coaxial cable connector 100 may be operably affixed to a prepared end of a coaxial cable 10 so that the cable 10 is securely attached to the connector 100. The coaxial cable 10 may include a center conductive strand 18, surrounded by an interior dielectric 16; the interior dielectric 16 may possibly be surrounded by a conductive foil layer; the interior dielectric 16 (and the possible conductive foil layer) is surrounded by a conductive strand layer 14; the conductive strand layer 14 is surrounded by a protective outer jacket 12*a*, wherein the protective outer jacket 12 has dielectric properties and serves as an insulator. The conductive strand layer 14 may extend a grounding path providing an electromagnetic shield about the center conductive strand 18 of the coaxial cable 10. The coaxial cable 10 may be prepared by removing the protective outer jacket 12 and drawing back the conductive strand layer 14 to expose a portion of the interior dielectric 16 (and possibly the conductive foil layer that may tightly surround the interior dielectric 16) and center conductive strand 18. The protective outer jacket 12 can physically protect the various components of the coaxial cable 10 from damage which may result from exposure to dirt or moisture, and from corrosion. Moreover, the protective outer jacket 12 may serve in some measure to secure the various components of the coaxial cable 10 in a contained cable design that protects the cable 10 from damage related to movement during cable installation. However, when the protective outer jacket 12 is exposed to the environment, rain and other environmental pollutants may travel down the protective outer jack 12. The conductive strand layer 14 can be comprised of conductive materials suitable for carrying electromagnetic signals and/or providing an electrical ground connection or electrical path connection. The conductive strand layer 14 may also be a conductive layer, braided layer, and the like. Various embodiments of the conductive strand layer 14 may be employed to screen unwanted noise. For instance, the conductive strand layer 14 may comprise a metal foil (in addition to the possible conductive foil) wrapped around the dielectric 16 and/or several conductive strands formed in a continuous braid around the dielectric 16. Combinations of foil and/or braided strands may be utilized wherein the conductive strand layer 14 may comprise a foil layer, then a braided layer, and then a foil layer. Those in the art will appreciate that various layer combinations may be implemented in order for the conductive strand layer 14 to effectuate an electromagnetic buffer helping to prevent ingress of environmental noise or unwanted noise that may disrupt broadband communications. In some embodiments, there may be flooding compounds protecting the conductive strand layer 14. The dielectric 16 may be comprised of materials suitable for electrical insulation. The protective outer jacket 12 may also be comprised of materials suitable for electrical insulation. It should be noted that the various materials of which all the various components of the coaxial cable 10 should have some degree of elasticity allowing the cable 10 to flex or bend in accordance with traditional broadband communications standards, installation methods and/or equipment. It should further be recognized that the radial thickness of the coaxial cable 10, protective outer jacket 12, conductive strand layer 14, possible conductive foil layer, interior dielectric 16 and/or center conductive strand 18 may vary based upon generally recognized parameters corresponding to broadband communication standards and/or equipment.

Furthermore, environmental elements that contact conductive components, including metallic components, of a coaxial connector may be important to the longevity and efficiency of the coaxial cable connector (i.e. preventing RF leakage and ensuring stable continuity through the connector 100). Environmental elements may include any environmental pollutant, any contaminant, chemical compound, rainwater, moisture, condensation, stormwater, polychlorinated biphenyl's (PCBs), contaminated soil from runoff, pesticides, herbicides, and the like. Environmental elements, such as water or moisture, may corrode, rust, degrade, etc. connector components exposed to the environmental elements. Thus, metallic conductive O-rings utilized by a coaxial cable connector that may be disposed in a position of exposure to environmental elements may be insufficient over time due to the corrosion, rusting, and overall degradation of the metallic O-ring.

Referring back to FIG. 1, the connector 100 may mate with a coaxial cable interface port 20. The coaxial cable interface port 20 includes a conductive receptacle 22 for receiving a portion of a coaxial cable center conductor 18 sufficient to make adequate electrical contact. The coaxial cable interface port 20 may further comprise a threaded exterior surface 24. However, various embodiments may employ a smooth surface, as opposed to threaded exterior surface. In addition, the coaxial cable interface port 20 may comprise a mating edge 26. It should be recognized that the radial thickness and/or the length of the coaxial cable interface port 20 and/or the conductive receptacle 22 may vary based upon generally recognized parameters corresponding to broadband communication standards and/or equipment. Moreover, the pitch and depth of threads which may be formed upon the threaded exterior surface 24 of the coaxial cable interface port 20 may also vary based upon generally recognized parameters corresponding to broadband communication standards and/or equipment. Furthermore, it should be noted that the interface port 20 may be formed of a single conductive material, multiple conductive materials, or may be configured with both conductive and non-conductive materials corresponding to the port's 20 electrical interface with a coaxial cable connector, such as connector 100. For example, the threaded exterior surface may be fabricated from a conductive material, while the material comprising the mating edge 26 may be non-conductive or vice versa. However, the conductive receptacle 22 should be formed of a conductive material. Further still, it will be understood by those of ordinary skill that the interface port 20 may be embodied by a connective interface component of a communications modifying device such as a signal splitter, a cable line extender, a cable network module and/or the like.

Referring further to FIG. 1, embodiments of a connector 100 may include a post 40, a coupling element 30, a connector body 50, a fastener member 60, and a biasing member 70. Embodiments of connector 100 may also include a post 40 having a first end 41, a second end 42, and a flange 45 proximate the second end 42, wherein the post 40 is configured to receive a center conductor 18 surrounded by a dielectric 16 of a coaxial cable 10, a connector body 50 attached to the post 40, a coupling element 30 attached to the post 40, the coupling element 30 having a first end 31 and a second end 32, and a biasing member 70 disposed within a cavity 38 formed between the first end 31 of the coupling element 30 and the connector body 50 to bias the coupling element 30 against the post 40.

Figure 3:
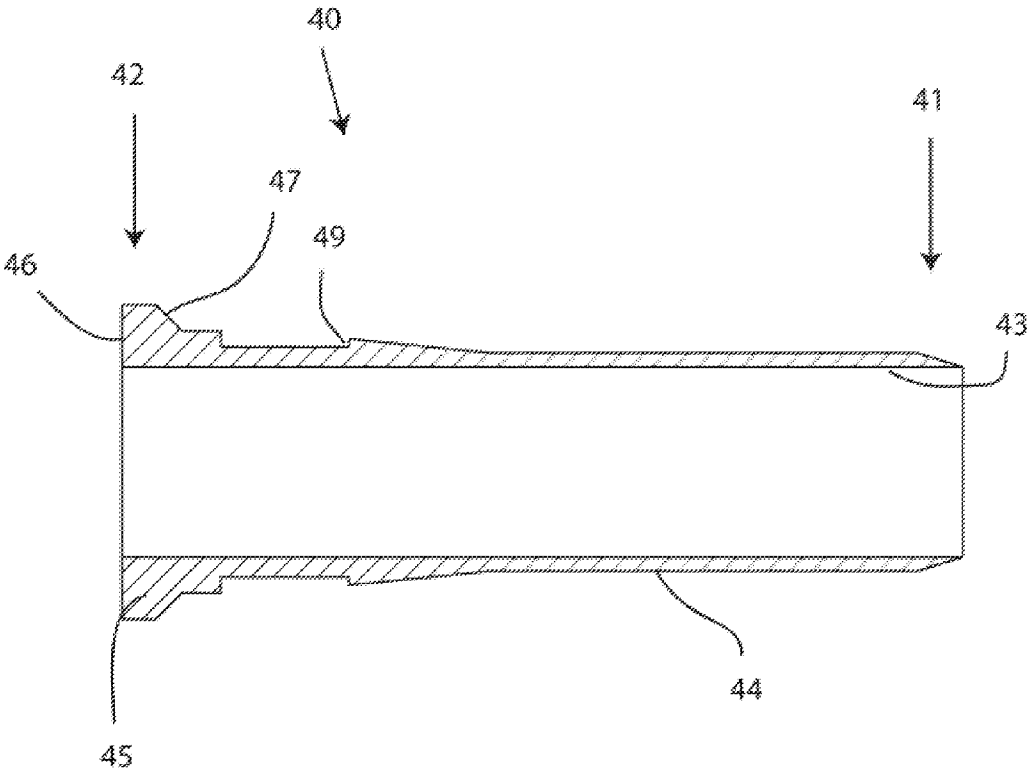
FIG. 3 depicts a cross-sectional view of an embodiment of a post.

Embodiments of connector 100 may include a post 40, as further shown in FIG. 3. The post 40 comprises a first end 41, a second end 42, an inner surface 43, and an outer surface 44. Furthermore, the post 40 may include a flange 45, such as an externally extending annular protrusion, located proximate or otherwise near the second end 42 of the post 40. The flange 45 may include an outer tapered surface 47 facing the first end 41 of the post 40 (i.e. tapers inward toward the first end 41 from a larger outer diameter proximate or otherwise near the second end 42 to a smaller outer diameter. The outer tapered surface 47 of the flange 45 may correspond to a tapered surface of the lip 36 of the coupling element 30. Further still, an embodiment of the post 40 may include a surface feature 49 such as a lip or protrusion that may engage a portion of a connector body 50 to secure axial movement of the post 40 relative to the connector body 50. However, the post may not include such a surface feature 49, and the coaxial cable connector 100 may rely on press-fitting and friction-fitting forces and/or other component structures to help retain the post 40 in secure location both axially and rotationally relative to the connector body 50. The location proximate or otherwise near where the connector body 50 is secured relative to the post 40 may include surface features, such as ridges, grooves, protrusions, or knurling, which may enhance the secure location of the post 40 with respect to the connector body 50. Additionally, the post 40 includes a mating edge 46, which may be configured to make physical and electrical contact with a corresponding mating edge 26 of an interface port 20. The post 40 should be formed such that portions of a prepared coaxial cable 10 including the dielectric 16 and center conductor 18 can pass axially into the first end 41 and/or through a portion of the tube-like body of the post 40. Moreover, the post 40 should be dimensioned such that the post 40 may be inserted into an end of the prepared coaxial cable 10, around the dielectric 16 and under the protective outer jacket 12 and conductive grounding shield or strand 14. Accordingly, where an embodiment of the post 40 may be inserted into an end of the prepared coaxial cable 10 under the drawn back conductive strand 14, substantial physical and/or electrical contact with the strand layer 14 may be accomplished thereby facilitating grounding through the post 40. The post 40 may be formed of metals or other conductive materials that would facilitate a rigidly formed post body. In addition, the post 40 may be formed of a combination of both conductive and non-conductive materials. For example, a metal coating or layer may be applied to a polymer of other non-conductive material. Manufacture of the post 40 may include casting, extruding, cutting, turning, drilling, knurling, injection molding, spraying, blow molding, component overmolding, or other fabrication methods that may provide efficient production of the component.

Figure 4:
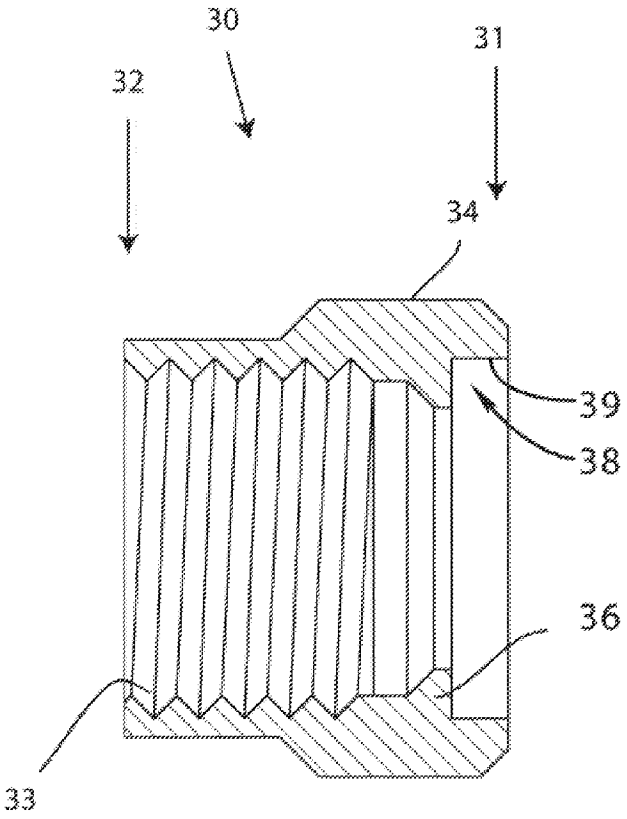
FIG. 4 depicts a cross-sectional view of an embodiment of a coupling element.

With continued reference to FIG. 1, and further reference to FIG. 4, embodiments of connector 100 may include a coupling element 30. The coupling element 30 may be a nut, a threaded nut, port coupling element, rotatable port coupling element, and the like. The coupling element 30 may include a first end 31, second end 32, an inner surface 33, and an outer surface 34. The inner surface 33 of the coupling element 30 may be a threaded configuration, the threads having a pitch and depth corresponding to a threaded port, such as interface port 20. In other embodiments, the inner surface 33 of the coupling element 30 may not include threads, and may be axially inserted over an interface port, such as port 20. The coupling element 30 may be rotatably secured to the post 40 to allow for rotational movement about the post 40. The coupling element 30 may comprise an internal lip 36 located proximate the first end 31 and configured to hinder axial movement of the post 40. Furthermore, the coupling element 30 may comprise a cavity 38 extending axially from the edge of first end 31 and partial defined and bounded by the internal lip 36. The cavity 38 may also be partially defined and bounded by an outer internal wall 39. The coupling element 30 may be formed of conductive materials facilitating grounding through the coupling element 30, or threaded nut. Accordingly the coupling element 30 may be configured to extend an electromagnetic buffer by electrically contacting conductive surfaces of an interface port 20 when a coaxial cable connector, such as connector 100, is advanced onto the port 20. In addition, the coupling element 30 may be formed of non-conductive material and function only to physically secure and advance a connector 100 onto an interface port 20. Moreover, the coupling element 30 may be formed of both conductive and non-conductive materials. For example the internal lip 36 may be formed of a polymer, while the remainder of the coupling element 30 may be comprised of a metal or other conductive material. In addition, the coupling element 30 may be formed of metals or polymers or other materials that would facilitate a rigidly formed body. Manufacture of the coupling element 30 may include casting, extruding, cutting, turning, tapping, drilling, injection molding, blow molding, or other fabrication methods that may provide efficient production of the component. Those in the art should appreciate the various of embodiments of the nut 30 may also comprise a coupler member, or coupling element, having no threads, but being dimensioned for operable connection to a corresponding interface port, such as interface port 20.

Figure 5:
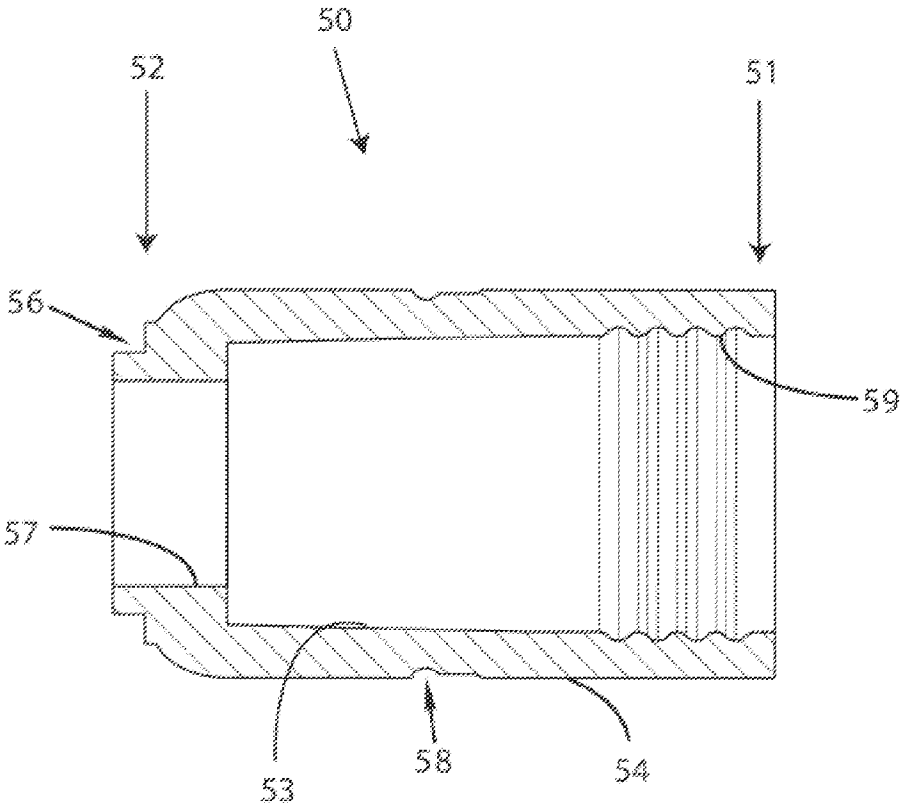
FIG. 5 depicts a cross-sectional view of a first embodiment of a connector body.

Referring still to FIG. 1, and additionally to FIG. 5, embodiments of a coaxial cable connector, such as connector 100, may include a connector body 50. The connector body 50 may include a first end 51, a second end 52, an inner surface 53, and an outer surface 54. Moreover, the connector body may include a post mounting portion 57 proximate or otherwise near the second end 52 of the body 50; the post mounting portion 57 configured to securely locate the body 50 relative to a portion of the outer surface 44 of post 40, so that the connector body 50 is axially secured with respect to the post 40, in a manner that prevents the two components from moving with respect to each other in a direction parallel to the axis of the connector 100. In addition, the connector body 50 may include an outer annular recess 56 located proximate or near the second end 52 of the connector body 50. Furthermore, the connector body 50 may include a semi-rigid, yet compliant outer surface 54, wherein the outer surface 54 may be configured to form an annular seal when the first end 51 is deformably compressed against a received coaxial cable 10 by operation of a fastener member 60. The connector body 50 may include an external annular detent 58 located along the outer surface 54 of the connector body 50. Further still, the connector body 50 may include internal surface features 59, such as annular serrations formed near or proximate the internal surface of the first end 51 of the connector body 50 and configured to enhance frictional restraint and gripping of an inserted and received coaxial cable 10, through tooth-like interaction with the cable. The connector body 50 may be formed of materials such as plastics, polymers, bendable metals or composite materials that facilitate a semi-rigid, yet compliant outer surface 54. Further, the connector body 50 may be formed of conductive or non-conductive materials or a combination thereof. Manufacture of the connector body 50 may include casting, extruding, cutting, turning, drilling, knurling, injection molding, spraying, blow molding, component overmolding, combinations thereof, or other fabrication methods that may provide efficient production of the component.

Figure 6:
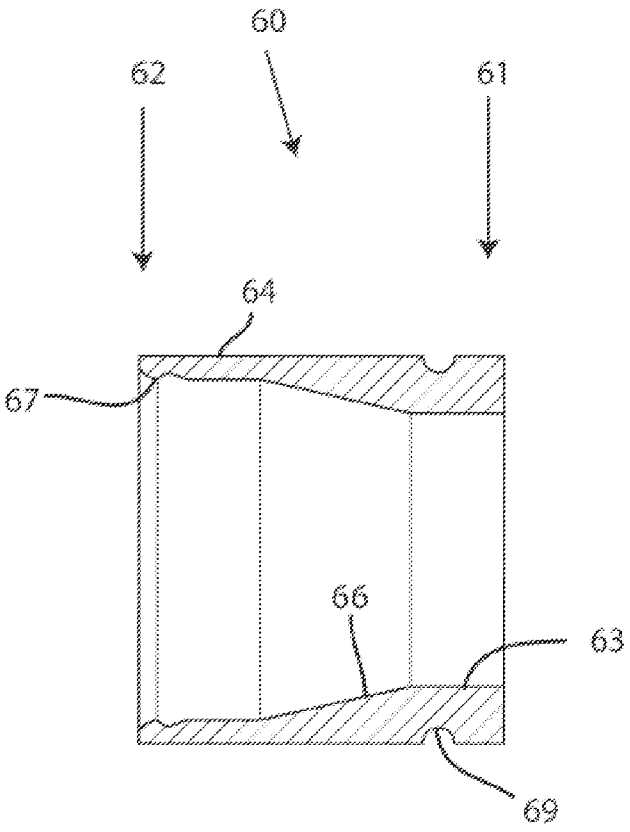
FIG. 6 depicts a cross-sectional view of an embodiment of a fastener member.

With further reference to FIG. 1 and FIG. 6, embodiments of a coaxial cable connector 100 may include a fastener member 60. The fastener member 60 may have a first end 61, second end 62, inner surface 63, and outer surface 64. In addition, the fastener member 60 may include an internal annular protrusion 67 located proximate the second end 62 of the fastener member 60 and configured to mate and achieve purchase with the annular detent 58 on the outer surface 54 of connector body 50. Moreover, the fastener member 60 may comprise a central passageway or generally axial opening defined between the first end 61 and second end 62 and extending axially through the fastener member 60. The central passageway may include a ramped surface 66 which may be positioned between a first opening or inner bore having a first inner diameter positioned proximate or otherwise near the first end 61 of the fastener member 60 and a second opening or inner bore having a larger, second inner diameter positioned proximate or otherwise near the second end 62 of the fastener member 60. The ramped surface 66 may act to deformably compress the outer surface 54 of the connector body 50 when the fastener member 60 is operated to secure a coaxial cable 10. For example, the narrowing geometry will compress squeeze against the cable, when the fastener member 60 is compressed into a tight and secured position on the connector body 50. Additionally, the fastener member 60 may comprise an exterior surface feature 69 positioned proximate with or close to the first end 61 of the fastener member 60. The surface feature 69 may facilitate gripping of the fastener member 60 during operation of the connector 100. Although the surface feature 69 is shown as an annular detent, it may have various shapes and sizes such as a ridge, notch, protrusion, knurling, or other friction or gripping type arrangements. The second end 62 of the fastener member 60 may extend an axial distance so that, when the fastener member 60 is compressed into sealing position on the coaxial cable 100, the fastener member 60 touches or resides substantially proximate significantly close to the coupling element 30. It should be recognized, by those skilled in the requisite art, that the fastener member 60 may be formed of rigid materials such as metals, hard plastics, polymers, composites and the like, and/or combinations thereof. Furthermore, the fastener member 60 may be manufactured via casting, extruding, cutting, turning, drilling, knurling, injection molding, spraying, blow molding, component overmolding, combinations thereof, or other fabrication methods that may provide efficient production of the component.

Referring back to FIG. 1, embodiments of a coaxial cable connector 100 can include a biasing member 70. The biasing member 70 may be formed of a non-metallic material to avoid rust, corrosion, deterioration, and the like, caused by environmental elements, such as water. Additional materials the biasing member 70 may be formed of may include, but are not limited to, polymers, plastics, elastomers, elastomeric mixtures, composite materials, rubber, and/or the like and/or any operable combination thereof. The biasing member 70 may be a resilient, rigid, semi-rigid, flexible, or elastic member, component, element, and the like. The resilient nature of the biasing member 70 may help avoid permanent deformation while under the torque requirements when a connector 100 is advanced onto an interface port 20.

Moreover, the biasing member 70 may facilitate constant contact between the coupling element 30 and the post 40. For instance, the biasing member 70 may bias, provide, force, ensure, deliver, etc. the contact between the coupling element 30 and the post 40. The constant contact between the coupling element 30 and the post 40 promotes continuity through the connector 100, reduces/eliminates RF leakage, and ensures a stable ground through the connection of a connector 100 to an interface port 20 in the event the connector 100 is not fully tightened onto the port 20. To establish and maintain solid, constant contact between the coupling element 30 and the post 40, the biasing member 70 may be disposed behind the coupling element 30, proximate or otherwise near the second end 52 of the connector. In other words, the biasing member 70 may be disposed within the cavity 38 formed between the coupling element 30 and the annular recess 56 of the connector body 50. The biasing member 70 can provide a biasing force against the coupling element 30, which may axially displace the coupling element 30 into constant direct contact with the post 40. In particular, the disposition of a biasing member 70 in annular cavity 38 proximate the second end 52 of the connector body 50 may axially displace the coupling element 30 towards the post 40, wherein the lip 36 of the coupling element 30 directly contacts the outer tapered surface 47 of the flange 45 of the post 40. The location and structure of the biasing member 70 may promote continuity between the post 40 and the coupling element 30, but does not impede the rotational movement of the coupling element 30 (e.g. rotational movement about the post 40). The biasing member 70 may also create a barrier against environmental elements, thereby preventing environmental elements from entering the connector 100. Those skilled in the art would appreciate that the biasing member 70 may be fabricated by extruding, coating, molding, injecting, cutting, turning, elastomeric batch processing, vulcanizing, mixing, stamping, casting, and/or the like and/or any combination thereof in order to provide efficient production of the component.

Embodiments of biasing member 70 may include an annular or semi-annular resilient member or component configured to physically and electrically couple the post 40 and the coupling element 30. One embodiment of the biasing member 70 may be a substantially circinate torus or toroid structure, or other ring-like structure having a diameter (or cross-section area) large enough that when disposed within annular cavity 38 proximate the annular recess 56 of the connector body 50, the coupling element 30 is axially displaced against the post 40 and/or biased against the post 40. Moreover, embodiments of the biasing member 70 may be an O-ring configured to cooperate with the annular recess 56 proximate the second end 52 of connector body 50 and the outer internal wall 39 and lip 36 forming cavity 38 such that the biasing member 70 may make contact with and/or bias against the annular recess 56 (or other portions) of connector body 50 and outer internal wall 39 and lip 36 of coupling element 30. The biasing between the outer internal wall 39 and lip 36 of the coupling element 30 and the annular recess 56, and surrounding portions, of the connector body 50 can drive and/or bias the coupling element 30 in a substantially axial or axial direction towards the second end 2 of the connector 100 to make solid and constant contact with the post 40. For instance, the biasing member 70 should be sized and dimensioned large enough (e.g. oversized O-ring) such that when disposed in cavity 38, the biasing member 70 exerts enough force against both the coupling element 30 and the connector body 50 to axial displace the coupling element 30 a distance towards the post 40. Thus, the biasing member 70 may facilitate grounding of the connector 100, and attached coaxial cable 10 (shown in FIG. 2), by extending the electrical connection between the post 40 and the coupling element 30. Because the biasing member 70 may not be metallic and/or conductive, it may resist degradation, rust, corrosion, etc., to environmental elements when the connector 100 is exposed to such environmental elements. Furthermore, the resiliency of the biasing member 70 may deform under torque requirements, as opposed to permanently deforming in a manner similar to metallic or rigid components under similar torque requirements. Axial displacement of the connector body 50 may also occur, but the surface 49 of the post 40 may prevent axial displacement of the connector body 50, or friction fitting between the connector body 50 and the post 40 may prevent axial displacement of the connector body 50.

Figure 7:
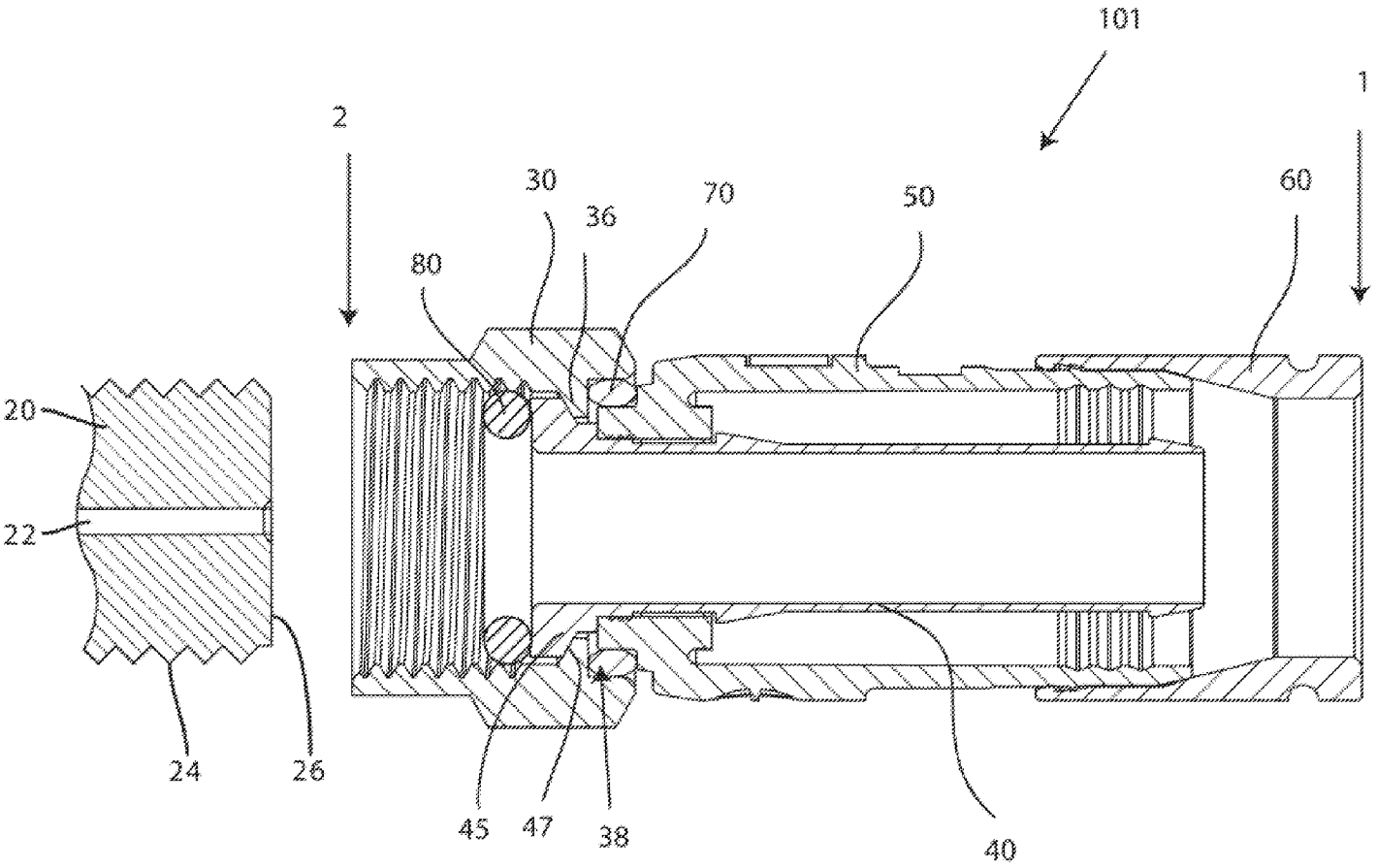
FIG. 7 depicts a cross-sectional view of a second embodiment of a coaxial cable connector.

With continued reference to the drawings, FIG. 7 depicts an embodiment of connector 101. Connector 101 may include post 40, coupling element 30, connector body 50, fastener member 60, biasing member 70, but may also include a mating edge conductive member 80 formed of a conductive material. Such materials may include, but are not limited to conductive polymers, conductive plastics, conductive elastomers, conductive elastomeric mixtures, composite materials having conductive properties, soft metals, conductive rubber, and/or the like and/or any operable combination thereof. The mating edge conductive member 80 may comprise a substantially circinate torus or toroid structure, and may be disposed within the internal portion of coupling element 30 such that the mating edge conductive member 80 may make contact with and/or reside continuous with a mating edge 46 of a post 40 when connector 101 is operably configured (e.g. assembled for communication with interface port 20). For example, one embodiment of the mating edge conductive member 80 may be an O-ring. The mating edge conductive member 80 may facilitate an annular seal between the coupling element 30 and post 40 thereby providing a physical barrier to unwanted ingress of moisture and/or other environmental contaminates. Moreover, the mating edge conductive member 80 may facilitate electrical coupling of the post 40 and coupling element 30 by extending therebetween an unbroken electrical circuit. In addition, the mating edge conductive member 80 may facilitate grounding of the connector 100, and attached coaxial cable (shown in FIG. 2), by extending the electrical connection between the post 40 and the coupling element 30. Furthermore, the mating edge conductive member 80 may effectuate a buffer preventing ingress of electromagnetic noise between the coupling element 30 and the post 40. The mating edge conductive member or O-ring 80 may be provided to users in an assembled position proximate the second end 42 of post 40, or users may themselves insert the mating edge conductive O-ring 80 into position prior to installation on an interface port 20. Those skilled in the art would appreciate that the mating edge conductive member 80 may be fabricated by extruding, coating, molding, injecting, cutting, turning, elastomeric batch processing, vulcanizing, mixing, stamping, casting, and/or the like and/or any combination thereof in order to provide efficient production of the component.

Figure 8A:
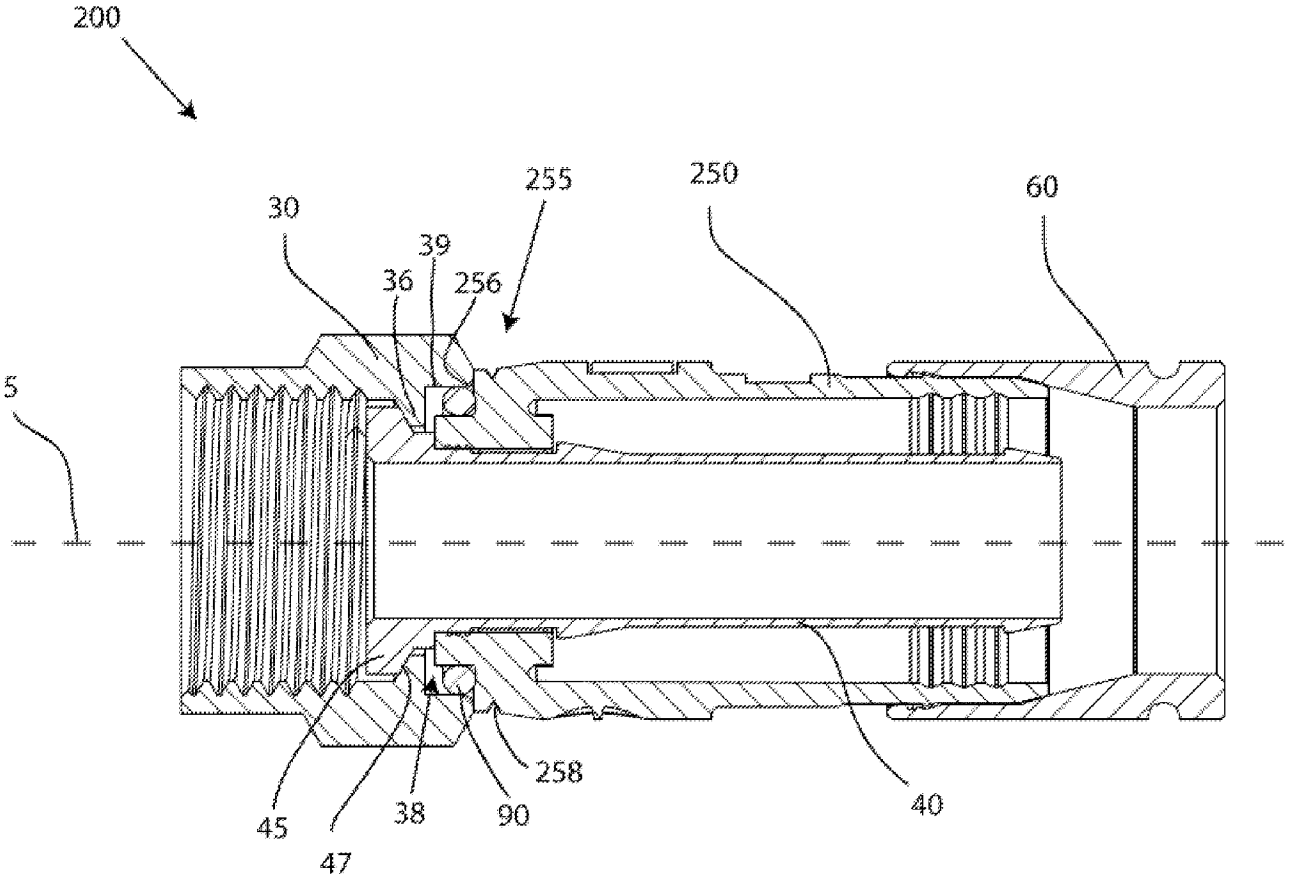
FIG. 8A depicts a cross-sectional view of a third embodiment of a coaxial cable connector.
Figure 8B:
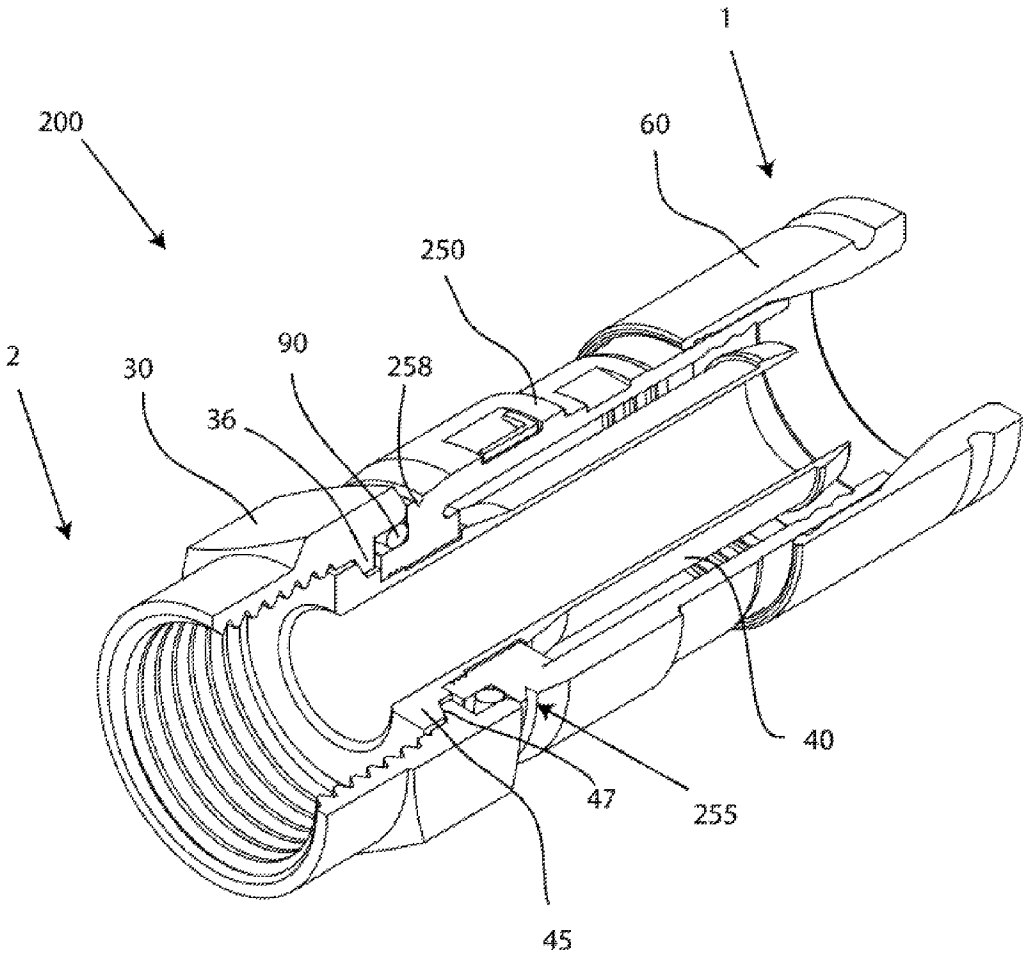
FIG. 8B depicts a perspective cut-away of the third embodiment of a coaxial cable connector.
Figure 10A:
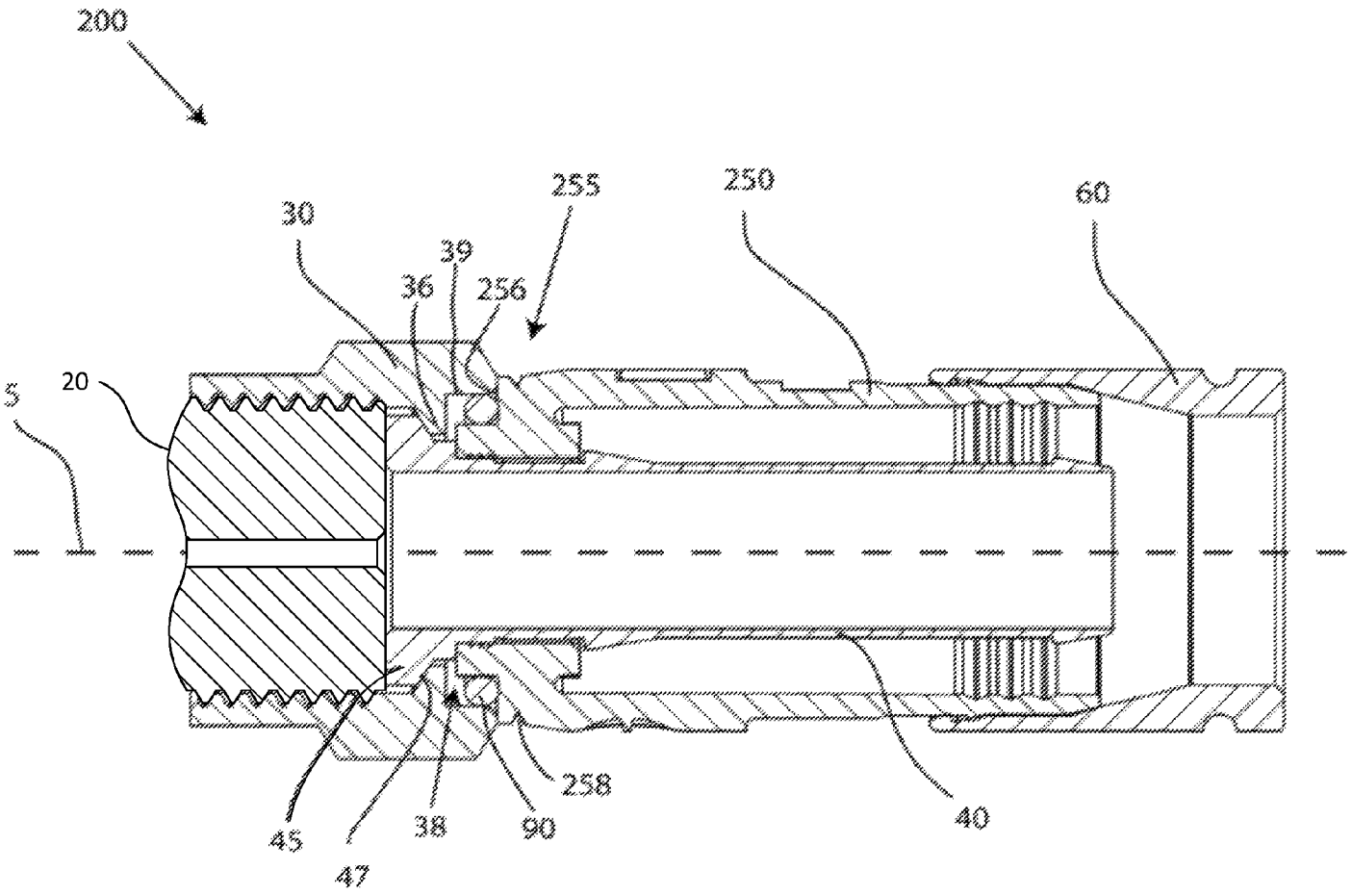
FIG. 10A depicts a cross-sectional view of the connector shown in FIG. 8A, with the connector fully tightened onto an interface port.

Referring now to FIGS. 8A, 8B, and 10A, an embodiment of connector 200 is described. Embodiments of connector 200 may include a post 40, a coupling element 30, a fastener member 60, a connector body 250 having biasing element 255, and a connector body member 90. Embodiments of the post 40, coupling element 30, and fastener member 60 described in association with connector 200 may share the same structural and functional aspects as described above in association with connectors 100, 101. Embodiments of connector 200 may also include a post 40 having a first end 41, a second end 42, and a flange 45 proximate the second end 42. Additionally, the post 40 includes a mating edge 46 (FIG. 3), which may be configured to make physical and electrical contact with a corresponding mating edge 26 (FIG. 7) of an interface port 20. The post 40 is configured to receive a center conductor surrounded 18 by a dielectric 16 of a coaxial cable 10, a coupling element 30 attached to the post 40, the coupling element 30 having a first end 31 and a second end 32, and a connector body 250 having biasing element 255, wherein the engagement biasing element 255 biases the coupling element 30 against the post 40.

Figure 9:
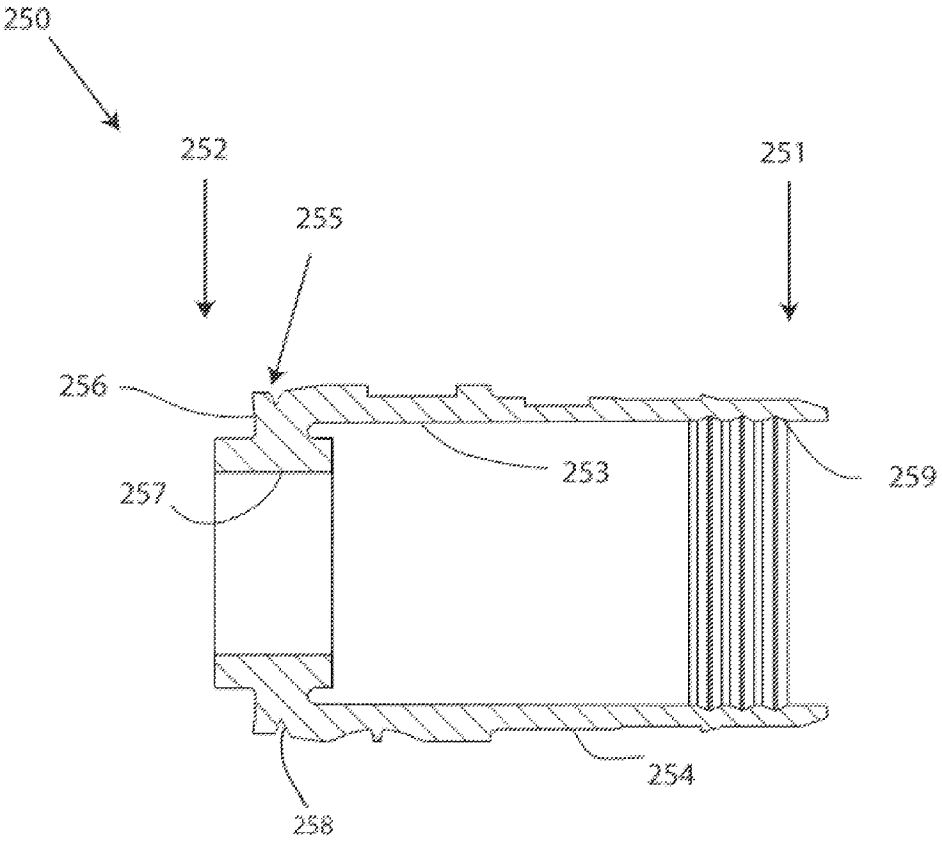
FIG. 9 depicts a cross-sectional view of a second embodiment of a connector body.

With reference now to FIG. 9, and continued reference to FIGS. 8A and 8B, embodiments of connector 200 may include a connector body 250 having a biasing element 255. The connector body 250 may include a first end 251, a second end 252, an inner surface 253, and an outer surface 254. Moreover, the connector body 250 may include a post mounting portion 257 proximate or otherwise near the second end 252 of the body 250; the post mounting portion 257 configured to securely locate the body 250 relative to a portion of the outer surface 44 of post 40, so that the connector body 250 is axially secured with respect to the post 40, in a manner that prevents the two components from moving with respect to each other in a direction parallel to the axis of the connector 200. In addition, the connector body 250 may include an extended, resilient outer annular surface 256 located proximate or near the second end 252 of the connector body 250. The extended, resilient annular surface 256 may extend a radial distance with respect to a general axis 5 of the connector 200 to facilitate biasing engagement with the coupling element 30. For instance, the extended annular surface 256 may radially extend past the internal wall 39 of the coupling element 30. In one embodiment, the extended, resilient annular surface 256 may be a resilient extension of annular recess 56 of connector body 50. In other embodiments, the extended, resilient annular surface 256, or shoulder, may function as a biasing element 255 proximate the second end 252. The biasing element 255 may be structurally integral with the connector body 250, such that the biasing element 255 is a portion of the connector body 250. In other embodiments, the biasing element 255 may be a separate component fitted or configured to be coupled with (e.g. adhered, snapped on, interference fit, and the like) an existing connector body, such as connector body 50. Moreover, the biasing element 255 of connector body 250 may be defined as a portion of the connector body 255, proximate the second end 252, that extends radially and potentially axially (slightly) from the body to bias the coupling element 30, proximate the first end 31, into contact with the post 40. The biasing element 255 may include a notch 258 to permit the necessary deflection to provide a biasing force to effectuate constant physical contact between the lip 36 of the coupling element 30 and the outer tapered surface 47 of the flange 45 of the post 40. The notch 258 may be a notch, groove, channel, or similar annular void that results in an annular portion of the connector body 50 that is removed to permit deflection in an axial direction with respect to the general axis 5 of connector 200.

Figure 10B:
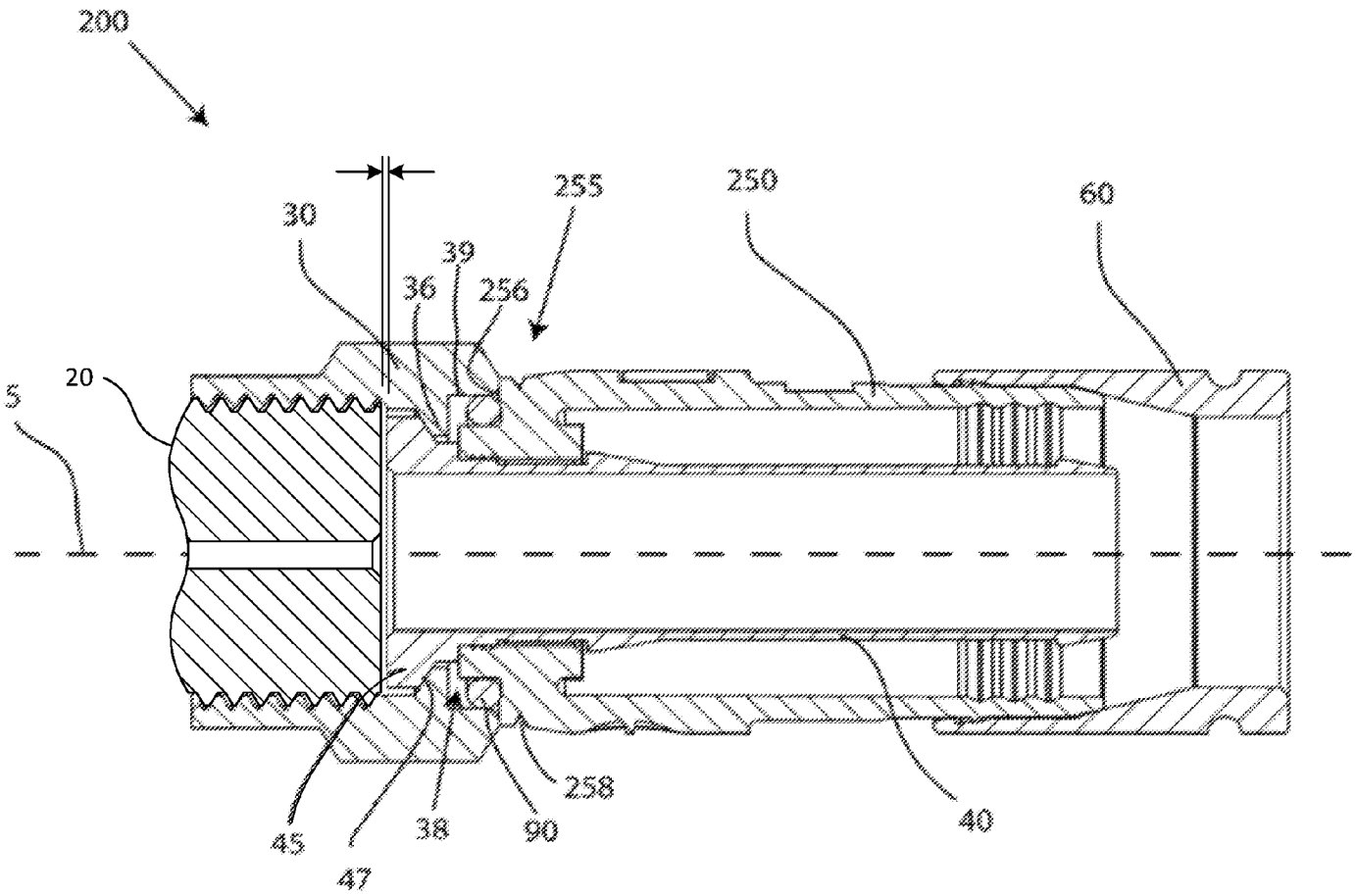
FIG. 10B depicts a cross-sectional view of the connector shown in FIG. 10A, except the connector is not fully tightened onto the interface port.

Accordingly, a portion of the extended, resilient annular surface 256, or the biasing element 255, may engage the coupling element 30 to bias the coupling element 30 into contact with the post 40. Contact between the coupling element 30 and the post 40 may promote continuity through the connector 200, reduce/eliminate RF leakage, and ensure a stable ground through the connection of the connector 200 to an interface port 20 in the event the connector 200 is not fully tightened onto the port 20, as shown in FIG. 10B. In most embodiments, the extended annular surface 256 or the biasing element 255 of the connector body 250 may provide a constant biasing force behind the coupling element 30. The biasing force provided by the extended annular surface 256, or biasing element 255, behind the coupling element 30 may result in constant contact between the lip 36 of the coupling element 30 and the outward tapered surface 47 of the post 40. However, the biasing force of the extending annular surface 256, or biasing element 255, should not (significantly) hinder or prevent the rotational movement of the coupling element 30 (i.e. rotation of the coupling element 30 about the post 40). Because connector 200 may include connector body 250 having an extended, resilient annular surface 256 to improve continuity, there may be no need for an additional component such as a metallic conductive continuity member that is subject to corrosion and permanent deformation during operable advancement and disengagement with an interface port 20, which may ultimately adversely affect the signal quality (e.g. corrosion or deformation of conductive member may degrade the signal quality).

Furthermore, the connector body 250 may include a semi-rigid, yet compliant outer surface 254, wherein the outer surface 254 may be configured to form an annular seal when the first end 251 is deformably compressed against a received coaxial cable 10 by operation of a fastener member 60. Further still, the connector body 250 may include internal surface features 259, such as annular serrations formed near or proximate the internal surface of the first end 251 of the connector body 250 and configured to enhance frictional restraint and gripping of an inserted and received coaxial cable 10, through tooth-like interaction with the cable. The connector body 250 may be formed of materials such as plastics, polymers, bendable metals or composite materials that facilitate a semi-rigid, yet compliant outer surface 254. Further, the connector body 250 may be formed of conductive or non-conductive materials or a combination thereof. Manufacture of the connector body 250 may include casting, extruding, cutting, turning, drilling, knurling, injection molding, spraying, blow molding, component overmolding, combinations thereof, or other fabrication methods that may provide efficient production of the component.

Further embodiments of connector 200 may include a connector body member 90 formed of a conductive or non-conductive material. Such materials may include, but are not limited to conductive polymers, plastics, elastomeric mixtures, composite materials having conductive properties, soft metals, conductive rubber, rubber, and/or the like and/or any workable combination thereof. The connector body member 90 may comprise a substantially circinate torus or toroid structure, or other ring-like structure. For example, an embodiment of the connector body member 90 may be an O-ring disposed proximate the second end 252 of connector body 250 and the cavity 38 extending axially from the edge of first end 31 and partially defined and bounded by an outer internal wall 39 of coupling element 30 (see FIG. 4) such that the connector body O-ring 90 may make contact with and/or reside contiguous with the extended annular surface 256 of connector body 250 and outer internal wall 39 of coupling element 30 when operably attached to post 40 of connector 200. The connector body member 90 may facilitate an annular seal between the coupling element 30 and connector body 250 thereby providing a physical barrier to unwanted ingress of moisture and/or other environmental elements. Moreover, the connector body member 90 may facilitate further electrical coupling of the connector body 250 and coupling element 30 by extending therebetween an unbroken electrical circuit if connector body member 90 is conductive (i.e. formed of conductive materials). In addition, the connector body member 90 may further facilitate grounding of the connector 200, and attached coaxial cable 10 by extending the electrical connection between the connector body 250 and the coupling element 30. Furthermore, the connector body member 90 may effectuate a buffer preventing ingress of electromagnetic noise between the coupling element 30 and the connector body 250. It should be recognized by those skilled in the relevant art that the connector body member 90 may be manufactured by extruding, coating, molding, injecting, cutting, turning, elastomeric batch processing, vulcanizing, mixing, stamping, casting, and/or the like and/or any combination thereof in order to provide efficient production of the component.

Referring to FIGS. 1-10B, a method of facilitating continuity through a coaxial cable connector 100 may include the steps of providing a post 40 having a first end 41, a second end 42, and a flange 45 proximate the second end 42, wherein the post 40 is configured to receive a center conductor 18 surrounded by a dielectric 16 of a coaxial cable 10, a connector body 50 attached to the post 40, and a coupling element 30 attached to the post 40, the coupling element 30 having a first end 31 and a second end 32, and disposing a biasing member 70 within a cavity 38 formed between the first end 31 of the coupling element 30 and the connector body 50 to bias the coupling element 30 against the post 40. Furthermore, a method of facilitating continuity through a coaxial cable connector 200 may include the steps of providing a post 40 having a first end 41, a second end 42, and a flange 45 proximate the second end 42, wherein the post 40 is configured to receive a center conductor 18 surrounded by a dielectric 16 of a coaxial cable 10, a coupling element 30 attached to the post 40, the coupling element 30 having a first end 31 and a second end 32, and a connector body 250 having a first end 251, a second end 252, and an annular surface 256 proximate the second end of the connector body, and extending the annular surface 256 a radial distance to engage the coupling element 30, wherein the engagement between the extended annular surface 256 and the coupling element 30 biases the coupling element 30 against the post 40.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

The following is claimed:

1. A connector attachable to a coaxial cable, the coaxial cable comprising a center conductive strand surrounded by a dielectric, the connector comprising:

a post comprising a first end, a second end, and a flange, wherein the post is configured to receive the center conductive strand;

a coupling element configured to engage the post and configured to move between a first position, where, as the coupling element is tightened onto an interface port, the post does not contact the interface port, and a second position, where, as the coupling element is tightened onto the interface port, the post contacts the interface port, the second position being axially spaced from the first position, the coupling element comprising a first end, a second end, and an inward lip; and a connector body configured to engage the post and receive a coaxial cable when the connector is in an assembled state, the connector body comprising:

an integral body biasing element comprising a coupling element contact portion configured to extend from the connector body when the connector is in the assembled state; and an annular groove configured to allow the integral body biasing element to deflect along an axial direction, wherein the integral body biasing element is configured to exert a biasing force against the coupling element sufficient to axially urge the inward lip of the coupling element away from the connector body and toward the flange of the post at least until the post contacts the interface port as the coupling element is tightened on the interface port, so as to improve electrical grounding reliability between the coupling element and the post, even when the post is not in contact with the interface port, wherein the coupling element is rotatable relative to the post while the biasing force is being exerted against the coupling element, wherein the post comprises a first component of the connector configured to make electrical contact with an outer conductor of the coaxial cable and the interface port when the connector is fully tightened onto the interface port, wherein the inward lip of the coupling element comprises an inward protrusion of the coupling element, wherein the connector body comprises a second component of the connector that is securable to the post at a first connector body end of the connector body and is configured to receive a first portion of the coaxial cable at a second connector body end of the connector body, wherein the biasing force comprises a force selected from the group consisting of a spring force and a pushing force, wherein the integral body biasing element comprises an integral portion of the connector body that is configured to constantly exert the spring force by pushing against the coupling element, the integral body biasing element being formed of a single, unitary structure with the connector body, wherein the coupling element contact portion or the integral body biasing element comprises a second portion of the integral body biasing element that is configured to engage the coupling element, wherein the sufficiency of the biasing force comprises an adequate force to push the inward lip of the coupling element in a direction toward the flange of the post, wherein the annular groove comprises a narrow, ring-shaped channel formed by the connector body that is configured to allow: (a) the integral body biasing element to be deflected within the narrow, ring-shaped channel; and (b) the integral body biasing element to exert the constantly exerted spring force, and wherein the improving of the electrical grounding reliability between the coupling element and the post comprises helping to maintain a reliable ground path through the coupling element and the post.

2. The connector of claim 1, wherein the connector body comprises a first part located rearward of the annular groove, the connector body being configured to enable the deflection without causing deformation of the first part of the connector body.

3. The connector of claim 1, wherein the connector body is configured to enable the deflection of the integral body biasing element without causing destruction of the connector body.

4. The connector of claim 1, wherein the integral body biasing element comprises a spring characteristic.

5. The connector of claim 1, wherein the dielectric is surrounded by the outer conductor, and the dielectric comprises an insulation material.

6. The connector of claim 1, wherein the coupling element contact portion is configured to enable rotation of the coupling element relative to the post while the biasing force is being exerted against the coupling element.

7. The connector of claim 1, wherein the integral body biasing element comprises a surface that projects axially to engage the coupling element, the surface projecting toward the coupling element.

8. The connector of claim 1, wherein the integral body biasing element is configured to constantly exert the biasing force against the coupling element, and the integral body biasing element is integrally formed with the connector body.

9. The connector of claim 1, wherein the integral body biasing element is made of a substantially non-metallic, non-conductive material.

10. The connector of claim 1, wherein the integral body biasing element operates with the annular groove, to permit the deflection so as to bias the coupling element against the post.

11. The connector of claim 1, wherein the flange of the post comprises a second surface, the integral body biasing element biasing the inward lip of the coupling element against the second surface.

12. The connector of claim 1, wherein the connector is in a partially tightened position when the coupling element is in the first position, and wherein the connector is in a fully tightened position when the coupling element is in the second position.

13. A connector attachable to a coaxial cable, the coaxial cable comprising a center conductive strand, surrounded by dielectric the connector comprising:

a post comprising a first post end, a second post end, and a flange, wherein the post is configured to receive the center conductive strand;

a coupling element configured to engage the post and configured to move between a first position, where, as the coupling element is tightened onto an interface port, the post does not contact the interface port, and a second position, where, as the coupling element is tightened onto the interface port, the post contacts the interface port, the second position being axially spaced from the first position, the coupling element comprising a first end, a second end, and an inward; and a connector body configured to engage the post and receive the coaxial cable when the connector is in an assembled state, the connector body comprising:

an integral body biasing element comprising a coupling element contact portion configured to extend from the connector body when the connector is in the assembled state; and an annular groove configured to allow the integral body biasing element to deflect along an axial direction, wherein the integral body biasing element is configured to exert a biasing force against the coupling element sufficient to axially urge the inward lip of the coupling element away from the connector body and toward the flange of the post at least until the post contacts the interface port as the coupling element is tightened on the interface port, so as to improve electrical grounding reliability between the coupling element and the post, even when the post is not in contact with the interface port, and wherein the coupling element is rotatable relative to the post while the biasing force is being exerted against the coupling element.

14. The connector of claim 13, wherein the integral body biasing element and the coupling element are configured to cooperate to enable the coupling element to rotate relative to the post while the biasing force is being exerted against the coupling element.

15. The connector of claim 13, wherein the post comprises a first component of the connector configured to make electrical contact with an outer conductor of the coaxial cable and the interface port when the connector is fully tighten onto the interface port.

16. The connector of claim 13, wherein the inward lip of the coupling element comprises an inward protrusion of the coupling element.

17. The connector of claim 13, wherein the connector body comprises a second component of the connector that is securable to the post at a first connector body end of the connector body and is configured to receive a first portion of the coaxial cable at a second connector body end of the connector body.

18. The connector of claim 13, wherein the biasing force comprises a force selected from the group consisting of a spring force and a pushing force.

19. The connector of claim 18, wherein the integral body biasing element comprises an integral portion of the connector body that is configured to constantly exert the spring force by pushing against the coupling element, the integral body biasing element being formed of a single, unitary structure with the connector body.

20. The connector of claim 13, wherein the coupling element contact portion of the integral body biasing element comprises a second portion of the integral body biasing element that is configured to engage the coupling element.

21. The connector of claim 13, wherein the coupling element comprises a plurality of threads.

22. The connector of claim 13, wherein the sufficiency of the biasing force comprises an adequate force to push the inward lip of the coupling element in a direction toward the flange of the post.

23. The connector of claim 19, wherein the annular groove comprises a narrow, ring-shaped channel formed by the connector body that is configured to allow: (a) the biasing element to be deflected within the narrow, ring-shaped channel; and (b) the integral body biasing element to exert the constantly exerted spring force.

24. The connector of claim 13, wherein the improving of the electrical grounding reliability between the coupling element and the post comprises helping to maintain a reliable ground path through the coupling element and the post.

25. The connector of claim 13, wherein the connector body comprises a first part located rearward of the annular groove, the connector body being configured to enable the deflection without causing deformation of the first part of the connector body.

26. The connector of claim 13, wherein the connector body is configured to enable the deflection of the integral body biasing element without causing destruction of the connector body.

27. The connector of claim 13, wherein the integral body biasing element comprises a spring characteristic.

28. The connector of claim 13, wherein the dielectric is surrounded by an outer conductor of the coaxial cable, and the dielectric corn insulation material.

29. The connector of claim 13, wherein the coupling element contact portion is configured to enable rotation of the coupling element relative to the post while the biasing force is being exerted against the coupling element.

30. The connector of claim 13, wherein the integral body biasing element comprises a surface that projects axially to engage the coupling element, the surface projecting toward the coupling element.

31. The connector of claim 13, wherein the integral body biasing element is configured to constantly exert the biasing force against the coupling element and the integral body biasing element is integrally formed with the connector body.

32. The connector of claim 13, wherein the integral body biasing element is made of a substantially non-metallic, non-conductive material.

33. The connector of claim 13, wherein the integral body biasing element operates with the annular groove to permit the deflection so as to bias the coupling element against the post.

34. The connector of claim 13, wherein the flange of the post comprises a second surface, the integral body biasing element biasing the inward lip of the coupling element against the second surface.

35. The connector of claim 13, wherein the connector is in a partially tightened position when the coupling element is in the first position, and wherein the connector is in a fully tightened position when the coupling element is in the second position.

36. A connector attachable to a coaxial cable, the coaxial cable comprising a center conductive strand surrounded by a dielectric, the connector comprising:

a post comprising a flange, the post configured to receive the center conductive strand;

a coupling means for coupling to an interface port, engaging the post, and axially moving between a first position, where the post does not engage the interface port, and a second position, where the post engages the interface port, the second position being axially spaced from the first position, the coupling, means comprising an inward lip, the coupling means also comprising a contact means facing a rearward direction; and a body means for engaging the coaxial cable when the connector is in an assembled state, the body means comprising:

a resilient biasing means for biasing the contact means of the coupling means when the connector is in the assembled state; and a deflection space means for allowing the resilient biasing means to flexibly deflect along an axial direction and exert a biasing force against the contact means of the coupling means sufficient to axially move the inward lip of the coupling means toward the flange of the post when the coupling means axially moves between the first position and the second position so as to improve electrical grounding continuity between the coupling means and the post even when the coupling means is not fully tightened relative to the interface port, wherein the coupling means is rotatable relative to the post while the biasing force is being exerted against the coupling means, wherein the post comprises a first component of the connector configured to make electrical contact with an outer conductor of the coaxial cable and the interface port when the connector is fully tightened onto the interface port, wherein the coupling means comprises a part selected from the group consisting of: (a) a nut; and (b) another element configured to allow the connector to be attached to the interface port, wherein the inward lip of the coupling means comprises an inward protrusion of the coupling means, wherein the contact means of the coupling means comprises a surface of the coupling means that the resilient biasing means pushes against, wherein the body means comprises a second component of the connector that is securable to the post at a first body means end of the body means and is configured to receive a first portion of the coaxial cable at a second body means end of the body means, wherein the biasing force comprises a force selected form the group consisting of a spring force and a pushing force, wherein the resilient biasing means comprises an integral portion of the body means that is configured to constantly exert the spring force by pushing against the coupling means, wherein the sufficiency of the biasing force comprises a adequate force to push the inward lip of the coupling means in a direction toward the flange of the post, wherein the deflection space means comprises a narrow, ring-shaped channel formed by the body means that is configured to allow: (a) the resilient biasing means to be deflected within the narrow, ring-shaped channel; and (b) the resilient biasing means to exert the constantly exerted spring force, and wherein the improving of the electrical grounding continuity between the coupling means and the post comprises helping to maintain a reliable ground path through the coupling means and the post.

37. The connector of claim 36, wherein the body means comprises a first part located rearward of the deflection space, the body means being configured to enable the deflection without causing deformation of the first part of the body means.

* * * * *